US012186802B2

(12) United States Patent
Suzuki et al.

(10) Patent No.: US 12,186,802 B2
(45) Date of Patent: Jan. 7, 2025

(54) CASTING EQUIPMENT AND CASTING METHOD

(71) Applicant: SINTOKOGIO, LTD., Nagoya (JP)

(72) Inventors: Umihiko Suzuki, Nagoya (JP); Atsushi Oiwa, Nagoya (JP); Minoru Onishi, Nagoya (JP)

(73) Assignee: SINTOKOGIO, LTD., Nagoya (JP)

( * ) Notice: Subject to any disclaimer, the term of this patent is extended or adjusted under 35 U.S.C. 154(b) by 0 days.

(21) Appl. No.: 18/328,175

(22) Filed: Jun. 2, 2023

(65) Prior Publication Data

US 2023/0415225 A1 Dec. 28, 2023

(30) Foreign Application Priority Data

Jun. 24, 2022 (JP) ..... 2022-101561

(51) Int. Cl.
*B22D 46/00* (2006.01)
*B22D 41/005* (2006.01)
*B22D 47/02* (2006.01)

(52) U.S. Cl.
CPC ..... *B22D 46/00* (2013.01); *B22D 41/005* (2013.01); *B22D 47/02* (2013.01)

(58) Field of Classification Search
CPC ..... B22D 41/005; B22D 46/00; B22D 47/02
USPC ..... 164/1, 4.1, 150.1, 154.1, 129, 130, 322, 164/323
See application file for complete search history.

(56) References Cited

U.S. PATENT DOCUMENTS

2009/0288794 A1* 11/2009 Lynn ..... B22D 46/00 164/151.4
2021/0304392 A1* 9/2021 Ota et al. ..... G06V 10/245

FOREIGN PATENT DOCUMENTS

JP 2004-009101 A 1/2004

* cited by examiner

*Primary Examiner* — Kevin P Kerns
(74) *Attorney, Agent, or Firm* — Oliff PLC

(57) ABSTRACT

There is provided casting equipment including a control device that acquires, regarding multiple processes in the casting equipment, specific data regarding casting molds in each frame, and that associates the specific data for the respective processes with the casting molds, separately for the casting molds in each frame; and a display device provided, with respect to a first process among the multiple processes and a second process later than the first process, on equipment for executing the second process. The control device displays, on the display device, the specific data for the first process associated with the casting molds that are to be processed in the second process.

7 Claims, 15 Drawing Sheets

| Casting mold ID no. | Molding time | Pattern no. | Casting result | Product no. | Product name | Material |
|---|---|---|---|---|---|---|
| 1 | 2016/6/13 7:04 | 57 | Molding defect | A-11 | | FC |
| 2 | 2016/6/13 7:07 | 57 | Molding defect | A-11 | | FC |
| 3 | 2016/6/13 7:08 | 57 | Molding defect | A-11 | | FC |
| 4 | 2016/6/13 7:09 | 57 | Melt poured | A-11 | | FC |
| 5 | 2016/6/13 7:10 | 57 | Melt poured | A-11 | | FC |
| 6 | 2016/6/13 7:10 | 57 | Melt poured | A-11 | | FC |
| 7 | 2016/6/13 7:11 | 57 | Melt poured | A-11 | | FC |
| 8 | 2016/6/13 7:11 | 57 | Melt poured | A-11 | | FC |
| 9 | 2016/6/13 7:11 | 57 | Melt poured | A-11 | | FC |
| 10 | 2016/6/13 7:12 | 57 | Melt poured | A-11 | | FC |

201

| Casting mold ID no. | Upper frame board setting complete position | Upper frame casting mold thickness | Upper frame compression rate | Lower frame board setting complete position | Lower frame casting mold thickness | Lower frame compression rate | Molding machine cycle |
|---|---|---|---|---|---|---|---|
| 1 | 269.2 | 209.0 | 22.3 | 265.4 | 214.8 | 19.0 | 236.4 |
| 2 | 250.4 | 192.0 | 23.3 | 240.8 | 197.0 | 18.1 | 21.4 |
| 3 | 248.4 | 187.5 | 24.5 | 233.7 | 184.2 | 21.1 | 112.6 |
| 4 | 252.3 | 188.2 | 25.4 | 242.6 | 187.5 | 22.7 | 21.0 |
| 5 | 254.9 | 190.1 | 25.4 | 246.6 | 187.3 | 24.0 | 21.0 |
| 6 | 255.0 | 189.7 | 25.6 | 250.8 | 189.1 | 24.6 | 20.8 |
| 7 | 255.5 | 188.2 | 26.3 | 252.1 | 188.8 | 25.1 | 20.9 |
| 8 | 258.0 | 189.4 | 26.5 | 253.9 | 189.3 | 25.4 | 20.8 |
| 9 | 259.0 | 190.3 | 26.5 | 254.7 | 188.9 | 25.8 | 21.1 |
| 10 | 258.6 | 189.8 | 26.6 | 256.3 | 192.3 | 24.9 | 20.7 |

| Casting mold ID no. | Core mounting time | Core installation time period 1 | Core installation time period 2 |
|---|---|---|---|
| 1 | 2016/6/13 7:04 | 0.0 | 15.2 |
| 2 | 2016/6/13 7:07 | 0.0 | 108.4 |
| 3 | 2016/6/13 7:08 | 0.0 | 14.1 |
| 4 | 2016/6/13 7:09 | 0.0 | 16.8 |
| 5 | 2016/6/13 7:10 | 0.0 | 17.3 |
| 6 | 2016/6/13 7:10 | 0.0 | 16.7 |
| 7 | 2016/6/13 7:11 | 0.0 | 17.6 |
| 8 | 2016/6/13 7:11 | 0.0 | 16.5 |
| 9 | 2016/6/13 7:11 | 0.0 | 16.6 |
| 10 | 2016/6/13 7:12 | 0.0 | 17.6 |

| Casting mold ID no. | Casting time | Ladle lot no. | Casting weight | Casting time period | Material no. | Frame no. | Inoculant added | Melt receiving duration | Casting temperature |
|---|---|---|---|---|---|---|---|---|---|
| 1 | | | | | | | | | |
| 2 | | | | | | | | | |
| 3 | | | | | | | | | |
| 4 | 2016/6/13 7:25 | 1 | 33.7 | 9.7 | 6 | 1 | 0.05 | 171 | 1346 |
| 5 | 2016/6/13 7:25 | 1 | 34.0 | 8.6 | 6 | 2 | 0.05 | 189 | 1332 |
| 6 | 2016/6/13 7:25 | 1 | 34.0 | 7.3 | 6 | 3 | 0.05 | 206 | 1327 |
| 7 | 2016/6/13 7:26 | 1 | 34.4 | 6.4 | 6 | 4 | 0.05 | 223 | 1337 |
| 8 | 2016/6/13 7:26 | 1 | 33.7 | 6.1 | 6 | 5 | 0.05 | 238 | 1355 |
| 9 | 2016/6/13 7:26 | 1 | 34.2 | 6.5 | 6 | 6 | 0.05 | 254 | 1333 |
| 10 | 2016/6/13 7:26 | 1 | 34.2 | 7.0 | 6 | 7 | 0.05 | 271 | 1336 |

| Casting mold ID no. | Molding time | Pattern no. | Inspection result | Product no. | Product name | Material |
|---|---|---|---|---|---|---|
| 1 | 2016/6/13 7:04 | 57 | | A-11 | | FFC |
| 2 | 2016/6/13 7:07 | 57 | | A-11 | | FFC |
| 3 | 2016/6/13 7:08 | 57 | | A-11 | | FFC |
| 4 | 2016/6/13 7:09 | 57 | Normal | A-11 | | FFC |
| 5 | 2016/6/13 7:10 | 57 | Normal | A-11 | | FFC |
| 6 | 2016/6/13 7:10 | 57 | Normal | A-11 | | FFC |
| 7 | 2016/6/13 7:11 | 57 | Normal | A-11 | | FFC |
| 8 | 2016/6/13 7:11 | 57 | Normal | A-11 | | FFC |
| 9 | 2016/6/13 7:11 | 57 | Normal | A-11 | | FFC |
| 10 | 2016/6/13 7:12 | 57 | Mold shift | A-11 | | FFC |

| Casting mold ID no | Mold knock-out time | Cooling time period |
|---|---|---|
| 1 | | |
| 2 | | |
| 3 | | |
| 4 | 2016/6/13 8:46 | 1:21:29 |
| 5 | 2016/6/13 8:47 | 1:21:32 |
| 6 | 2016/6/13 8:47 | 1:21:33 |
| 7 | 2016/6/13 8:47 | 1:21:41 |
| 8 | 2016/6/13 8:48 | 1:21:46 |
| 9 | 2016/6/13 8:48 | 1:21:51 |
| 10 | 2016/6/13 8:50 | 1:23:08 |

| Casting mold ID no | Mold knock-out time | Cooling time period | Casting temperature |
|---|---|---|---|
| 1 | | | |
| 2 | | | |
| 3 | | | |
| 4 | 2016/6/13 8:46 | 1:21:29 | 1346 |
| 5 | 2016/6/13 8:47 | 1:21:32 | 1332 |
| 6 | 2016/6/13 8:47 | 1:21:33 | 1327 |
| 7 | 2016/6/13 8:47 | 1:21:41 | 1337 |
| 8 | 2016/6/13 8:48 | 1:21:46 | 1355 |
| 9 | 2016/6/13 8:48 | 1:21:51 | 1333 |
| 10 | 2016/6/13 8:50 | 1:23:08 | 1336 |

| Casting mold ID no. | Mold knock-out time | Cooling time period | Pattern no. | Product no. |
|---|---|---|---|---|
| 1 | | | 57 | A-11 |
| 2 | | | 57 | A-11 |
| 3 | | | 57 | A-11 |
| 4 | 2016/6/13 8:46 | 1:21:29 | 57 | A-11 |
| 5 | 2016/6/13 8:47 | 1:21:32 | 57 | A-11 |
| 6 | 2016/6/13 8:47 | 1:21:33 | 57 | A-11 |
| 7 | 2016/6/13 8:47 | 1:21:41 | 57 | A-11 |
| 8 | 2016/6/13 8:48 | 1:21:46 | 57 | A-11 |
| 9 | 2016/6/13 8:48 | 1:21:51 | 57 | A-11 |
| 10 | 2016/6/13 8:50 | 1:23:08 | 57 | A-11 |

| Casting mold ID no. | Engraving time | Engraving type | Gate-cutting time | Inspection result |
|---|---|---|---|---|
| 1 | | | | |
| 2 | | | | |
| 3 | | | | |
| 4 | 2016/6/13 8:46 | A | 2016/6/13 8:46 | Normal |
| 5 | 2016/6/13 8:47 | A | 2016/6/13 8:47 | Normal |
| 6 | 2016/6/13 8:47 | A | 2016/6/13 8:47 | Normal |
| 7 | 2016/6/13 8:47 | A | 2016/6/13 8:47 | Normal |
| 8 | 2016/6/13 8:48 | A | 2016/6/13 8:48 | Normal |
| 9 | 2016/6/13 8:48 | A | 2016/6/13 8:48 | Normal |
| 10 | 2016/6/13 8:50 | A | 2016/6/13 8:50 | Normal |

Fig.13

10D,10N

B9

Sand treatment

208

| Casting mold ID no. | IDST measurement time | Sand temperature | CB | Water content | Aeration level | Aeration pressure | Compression strength | Mold release agent flow rate meter data 1 | Mold release agent flow rate meter data 2 | Mold release agent flow rate meter data 3 | Mold release agent flow rate meter data 4 |
|---|---|---|---|---|---|---|---|---|---|---|---|
| 1 | 2016/6/10 17:27 | 37.1 | 31 | 3 | 187 | 401 | 17.6 | 0 | 0 | 0 | 0 |
| 2 | 2016/6/10 17:27 | 37.1 | 31 | 3 | 187 | 401 | 17.6 | 0 | 0 | 0 | 0 |
| 3 | 2016/6/10 17:27 | 37.1 | 31 | 3 | 187 | 401 | 17.6 | 0 | 0 | 0 | 0 |
| 4 | 2016/6/10 17:27 | 37.1 | 31 | 3 | 187 | 401 | 17.6 | 0 | 0 | 0 | 0 |
| 5 | 2016/6/10 17:27 | 37.1 | 31 | 3 | 187 | 401 | 17.6 | 0 | 0 | 0 | 0 |
| 6 | 2016/6/10 17:27 | 37.1 | 31 | 3 | 187 | 401 | 17.6 | 0 | 0 | 0 | 0 |
| 7 | 2016/6/10 17:27 | 37.1 | 31 | 3 | 187 | 401 | 17.6 | 0 | 0 | 0 | 0 |
| 8 | 2016/6/10 17:27 | 37.1 | 31 | 3 | 187 | 401 | 17.6 | 0 | 0 | 0 | 0 |
| 9 | 2016/6/10 17:27 | 37.1 | 31 | 3 | 187 | 401 | 17.6 | 0 | 0 | 0 | 0 |
| 10 | 2016/6/10 17:27 | 37.1 | 31 | 3 | 187 | 401 | 17.6 | 0 | 0 | 0 | 0 |

Fig.14

11D,11N

B9 Sand treatment | B1 Product | B2 Casting mold | B4 Core | B5 Melt pouring | B7 Cooling conveyance | B8 Post-treatment | B30 Overall

| Casting mold ID no. | Molding time | Pattern no. | Product no. | IDST measurement time | Sand temperature | CB | Water content | Core mounting time | Casting time | Casting temperature | Mold knock-out time | Engraving time | Engraving type | Gate-cutting time | Inspection result |
|---|---|---|---|---|---|---|---|---|---|---|---|---|---|---|---|
| 1 | 2016/6/13 7:04 | 57 | A-11 | 2016/6/10 17:27 | 37.1 | 31 | 3 | 2016/6/13 7:04 | | | | | | | |
| 2 | 2016/6/13 7:07 | 57 | A-11 | 2016/6/10 17:27 | 37.1 | 31 | 3 | 2016/6/13 7:07 | | | | | | | |
| 3 | 2016/6/13 7:08 | 57 | A-11 | 2016/6/10 17:27 | 37.1 | 31 | 3 | 2016/6/13 7:08 | | | | | | | |
| 4 | 2016/6/13 7:09 | 57 | A-11 | 2016/6/10 17:27 | 37.1 | 31 | 3 | 2016/6/13 7:09 | 2016/6/13 7:25 | 1346 | 2016/6/13 8:46 | 2016/6/13 8:46 | A | 2016/6/13 8:46 | Normal |
| 5 | 2016/6/13 7:10 | 57 | A-11 | 2016/6/10 17:27 | 37.1 | 31 | 3 | 2016/6/13 7:10 | 2016/6/13 7:25 | 1332 | 2016/6/13 8:47 | 2016/6/13 8:47 | A | 2016/6/13 8:47 | Normal |
| 6 | 2016/6/13 7:10 | 57 | A-11 | 2016/6/10 17:27 | 37.1 | 31 | 3 | 2016/6/13 7:10 | 2016/6/13 7:25 | 1327 | 2016/6/13 8:47 | 2016/6/13 8:47 | A | 2016/6/13 8:47 | Normal |
| 7 | 2016/6/13 7:11 | 57 | A-11 | 2016/6/10 17:27 | 37.1 | 31 | 3 | 2016/6/13 7:11 | 2016/6/13 7:26 | 1337 | 2016/6/13 8:47 | 2016/6/13 8:47 | A | 2016/6/13 8:47 | Normal |
| 8 | 2016/6/13 7:11 | 57 | A-11 | 2016/6/10 17:27 | 37.1 | 31 | 3 | 2016/6/13 7:11 | 2016/6/13 7:26 | 1355 | 2016/6/13 8:48 | 2016/6/13 8:48 | A | 2016/6/13 8:48 | Normal |
| 9 | 2016/6/13 7:11 | 57 | A-11 | 2016/6/10 17:27 | 37.1 | 31 | 3 | 2016/6/13 7:11 | 2016/6/13 7:26 | 1333 | 2016/6/13 8:48 | 2016/6/13 8:48 | A | 2016/6/13 8:48 | Normal |
| 10 | 2016/6/13 7:12 | 57 | A-11 | 2016/6/10 17:27 | 37.1 | 31 | 3 | 2016/6/13 7:12 | 2016/6/13 7:26 | 1336 | 2016/6/13 8:50 | 2016/6/13 8:50 | A | 2016/6/13 8:50 | Normal |

CASTING EQUIPMENT AND CASTING METHOD

TECHNICAL FIELD

The present invention relates to casting equipment and a casting method.

BACKGROUND

Generally, in casting equipment, a casting is obtained by performing a casting process, i.e., by molding casting molds with molding sand, pouring melt (molten metal) into the casting molds, then cooling the casting molds and performing mold shake-out, and removing the casting from molding sand. In the case in which a casting having a hollow is to be cast, a core is mounted inside the casting molds. The molding sand that has been separated from the casting by performing mold shake-out is subjected to foreign-matter removal and sand cooling, then kneaded and conditioned, and reused for molding casting molds.

Patent Document 1 discloses a casting method and a casting line as described above.

CITATION LIST

Patent Literature

Patent Document 1: JP 2004-9101 A

SUMMARY OF INVENTION

Technical Problem

Castings that are cast by using casting equipment can sometimes have defects due to problems in the casting equipment or the like. Additionally, the operating environment of casting equipment is sometimes changed in order to improve the quality of castings. In such cases, there is a need to measure and analyze various data in the casting equipment, by means of various types of measuring devices, in order to analyze the defects and determine the problem in the casting equipment or to extract changes in the casting equipment that would be useful in improving the quality.

However, as already explained, multiple diverse processes are executed in casting equipment. For this reason, in the case in which there is a defect in a casting, for example, it is not easy to track and extract measurement data associated with said casting in the respective processes.

It is an object of the present invention to provide casting equipment and a casting method in which measurement data can be easily tracked and extracted across multiple processes.

Solution to Problem

The present invention solves the above-mentioned problems, by providing casting equipment comprising a control device that acquires, regarding multiple processes in the casting equipment, specific data regarding casting molds in each frame, and that associates the specific data for the respective processes with the casting molds, separately for the casting molds in each frame; and a display device provided, with respect to a first process among the multiple processes and a second process later than the first process, on equipment for executing the second process; wherein the control device displays, on the display device, the specific data for the first process associated with the casting molds that are to be processed in the second process.

Additionally, the present invention provides a casting method that includes acquiring, regarding multiple processes in casting equipment, specific data regarding casting molds in each frame, and associating the specific data for the respective processes with the casting molds, separately for the casting molds in each frame; and displaying, with respect to a first process among the multiple processes and a second process later than the first process, the specific data for the first process associated with the casting molds that are to be processed in the second process, on a display device provided in equipment for executing the second process.

Advantageous Effects of Invention

The present invention can provide casting equipment and a casting method in which measurement data can easily be tracked and extracted across multiple processes.

BRIEF DESCRIPTION OF DRAWINGS

FIG. 13 is an explanatory diagram of a screen on a display device displaying a sand treatment data table stored in the above-mentioned control device.

FIG. 14 is an explanatory diagram of a screen on a display device selecting and displaying representative specific data for all processes.

DESCRIPTION OF EMBODIMENTS

Hereinafter, embodiments of the present invention will be explained in detail with reference to the drawings.

Figure 1:
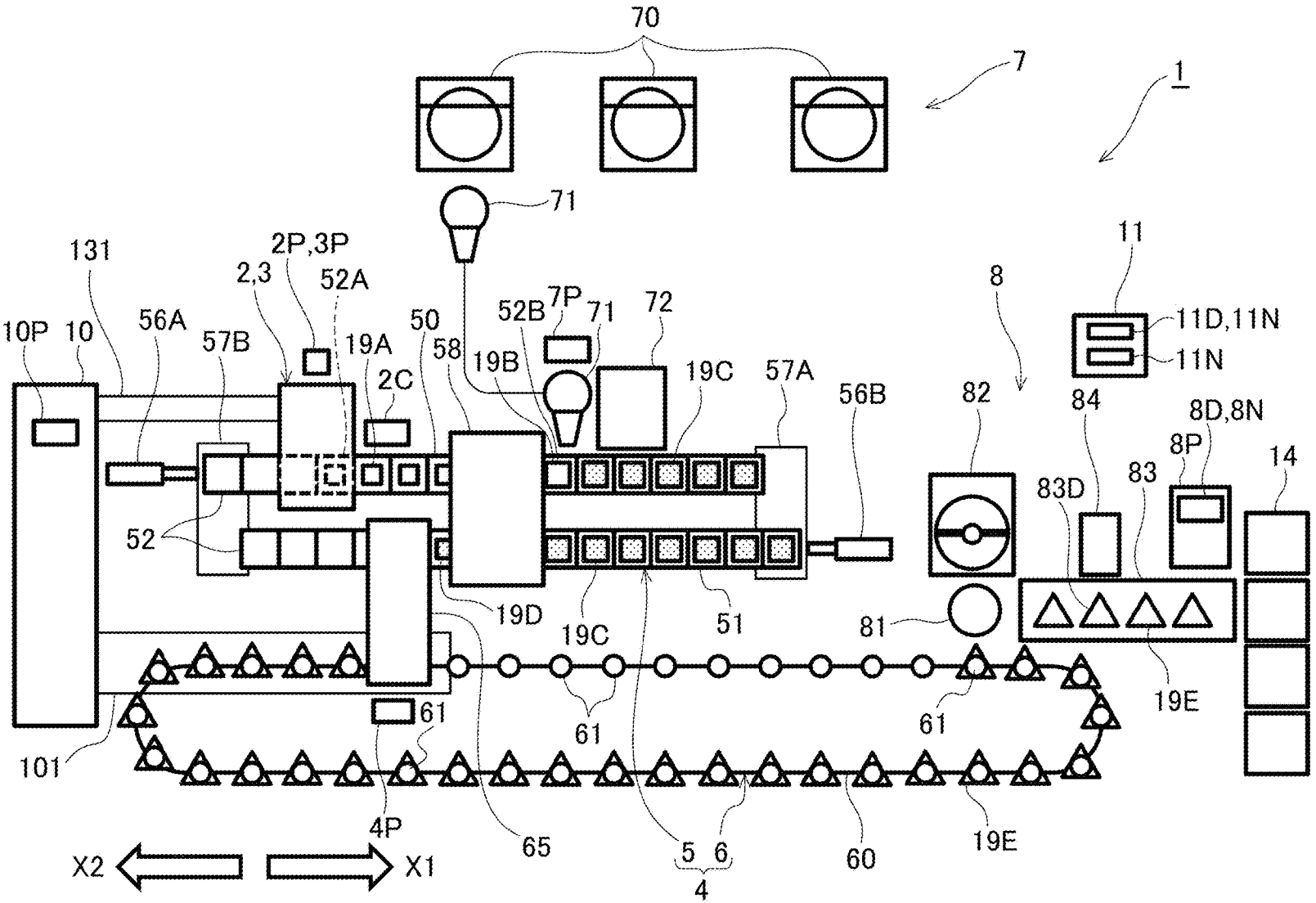
FIG. 1 is a schematic plan view of casting equipment in an embodiment of the present invention.
Figure 2:
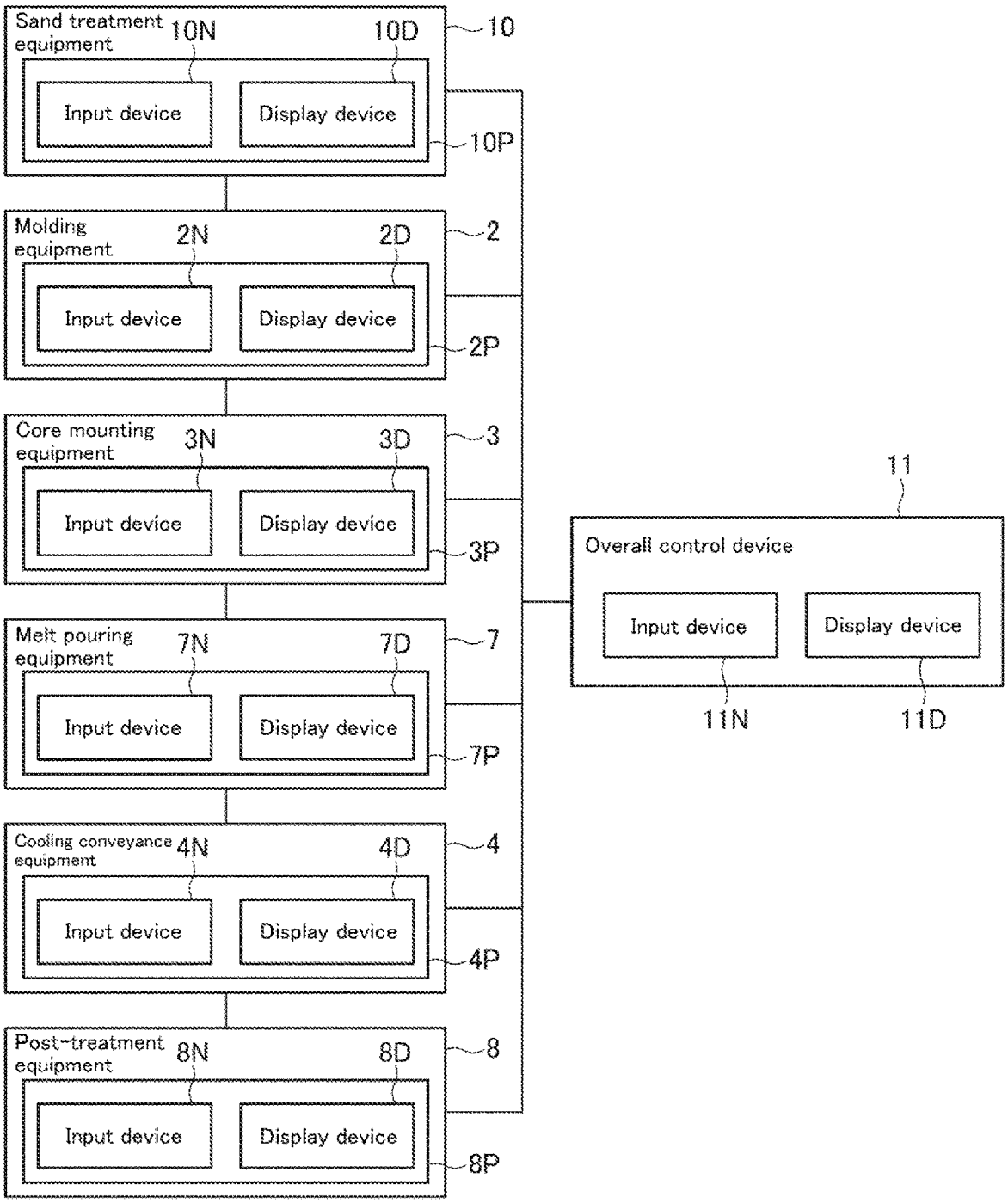
FIG. 2 is a block diagram of the above-mentioned casting equipment.

FIG. 1 is a schematic plan view of casting equipment 1 in the present embodiment. FIG. 2 is a block diagram of the casting equipment 1.

In the explanation below, when specifying a direction in the horizontal plane of the casting equipment 1, the direction to the right in FIG. 1 will be described as the first direction X1, and the direction to the left, i.e., the direction opposite to the first direction X1, will be described as the second direction X2.

When using the casting equipment 1 to produce a casting, multiple processes are executed, including a molding process, a core mounting process, a cooling conveyance process, a melt pouring process, a post-treatment process, and a sand treatment process. The casting equipment 1 is provided with molding equipment 2, core mounting equipment 3, cooling conveyance equipment 4, melt pouring equipment 7, post-treatment equipment 8, and sand treatment equipment 10 corresponding to each of these processes.

The molding equipment 2 molds casting molds from molding sand treated by the sand treatment equipment 10. The core mounting equipment 3 mounts a core inside casting molds. The melt pouring equipment 7 prepares and pours melt (molten metal) in the casting molds. The cooling conveyance equipment 4 conveys the casting molds that have been molded in the molding equipment 2, to the melt pouring equipment 7. The cooling conveyance equipment 4 also conveys the casting molds in which the melt has been cast by the melt pouring equipment 7 while cooling the same, perform a mold shake-out and removes a casting from the molding sand, and then conveys the removed casting, while cooling the same, to the post-treatment equipment 8. The post-treatment equipment 8 performs post-treatments on the casting, such as engraving the casting or gate-cutting the casting. The sand treatment equipment 10 treats the molding sand used for molding the casting molds.

Additionally, the casting equipment 1 is provided with a control device for control the above equipment to perform the corresponding process. In the present embodiment, the control device is provided with an overall control device 11 and, with respect to the respective equipment 2, 3, 4, 7, 8, and 10, control panels 2P, 3P, 4P, 7P, 8P, and 10P for controlling said equipment 2, 3, 4, 7, 8, and 10.

First, the casting equipment 2 and the core mounting equipment 3 will be explained.

The casting equipment 2 molds casting molds from molding sand. In the casting equipment 2, an upper casting mold and a lower casting mold are molded. In the present embodiment, the casting equipment 2 is of the flaskless type, and the upper casting mold and the lower casting mold that have been molded are removed from an upper frame and a lower frame, respectively.

Additionally, in the present embodiment, the core mounting equipment 3 for mounting a core inside casting molds is provided in the molding equipment 2. That is, the upper casting mold and the lower casting mold that have been molded are temporarily vertically separated from each other in the molding equipment 2, and after the core is mounted, the molds are matched together and discharged to the cooling conveyance equipment 4.

In the present embodiment, casting molds are molded and discharged at a processing timing indicated by an overall control device 11 to be explained below, basically in a predetermined casting cycle, e.g., one set of molds approximately every 40 seconds. In this case, a casting cycle is a single unit of processing in which the casting molds in each frame are processed, for each of the processes in the casting equipment 1.

The molding equipment 2 is provided with a control panel (control device) 2P and a timer for measuring the time at which a casting mold is molded. The timer measures, as the molding time, the time at which the squeezing of the upper casting mold and the lower casting mold by a squeeze board in the molding equipment 2 ends, and sends the molding time to the control panel 2P in the molding equipment 2.

The control panel 2P in the molding equipment 2 transmits the molding time of each casting mold to the overall control device 11 as specific data for each casting mold.

The molding equipment 2 is provided with various types of measuring devices that measure casting mold data such as an upper frame board setting completion position, an upper frame casting thickness (casting thickness), an upper frame compression rate (casting compression rate), and a lower frame board setting completion position. The control panel 2P on the molding equipment 2 receives these casting mold data that are measured by the various measuring devices, and sends the casting mold data to the overall control device 11 as specific data for each casting mold.

The core mounting equipment 3 is provided with a control panel (control device) 3P and a timer for measuring the time at which each core is mounted. In the present embodiment, as already explained, the core mounting equipment 3 is provided in the molding equipment 2. Therefore, in the present embodiment, the control panel 3P and the timer are the same as the control panel 2P and the timer in the molding equipment 2. The timer measures, as the core mounting time, the time at which the core is mounted inside a pair of an upper casting mold and a lower casting mold, and transmits the core mounting time to the control panel 3P in the core mounting equipment 3.

The timer in the core mounting equipment 3 further measures the core installation time period required for mounting the core.

The control panel 3P in the core mounting equipment 3 receives the core mounting time and the core installation time period, and transmits the core mounting time and the core installation time period to the overall control device 11 as specific data, i.e., as core data, for each casting mold.

The molding equipment 2 is further provided with an inspection device 2C. The molding equipment 2 is of the flaskless type, and therefore, the molding equipment 2 produces casting molds 19A that are obtained by placing an upper casting mold on a lower casting mold and matching them together, and the cooling conveyance equipment 4 to be explained below conveys these casting molds 19A to the melt pouring equipment 7. During this conveyance, the upper casting mold can become misaligned with respect to the lower casting mold, for example, in the case in which the conveyance speed is not appropriate or the like. In the present embodiment, the inspection device 2C is provided downstream from the main body of the molding equipment 2 on the conveyance path in the cooling conveyance equipment 4, and performs an inspection for mold shift as described above.

The molding equipment 2 transmits these mold shift inspection results from the inspection device 2C to the control panel 2P. The control panel 2P transmits the mold shift inspection results to the overall control device 11.

The cooling conveyance equipment 4 is provided with a primary cooling conveyance device 5, a secondary cooling conveyance device 6, a mold shake-out device 65, and a control panel (control device) 4P. The primary cooling conveyance device 5 receives casting molds molded by the molding equipment 2 and conveys the casting molds to the melt pouring equipment 7, at which melt is poured in the casting molds. Then while cooling the casting molds, the primary cooling conveyance device 5 conveys the castings, for which mold shake-out has been performed via the mold shake-out device 65, to the secondary cooling conveyance device 6.

Figure 3:
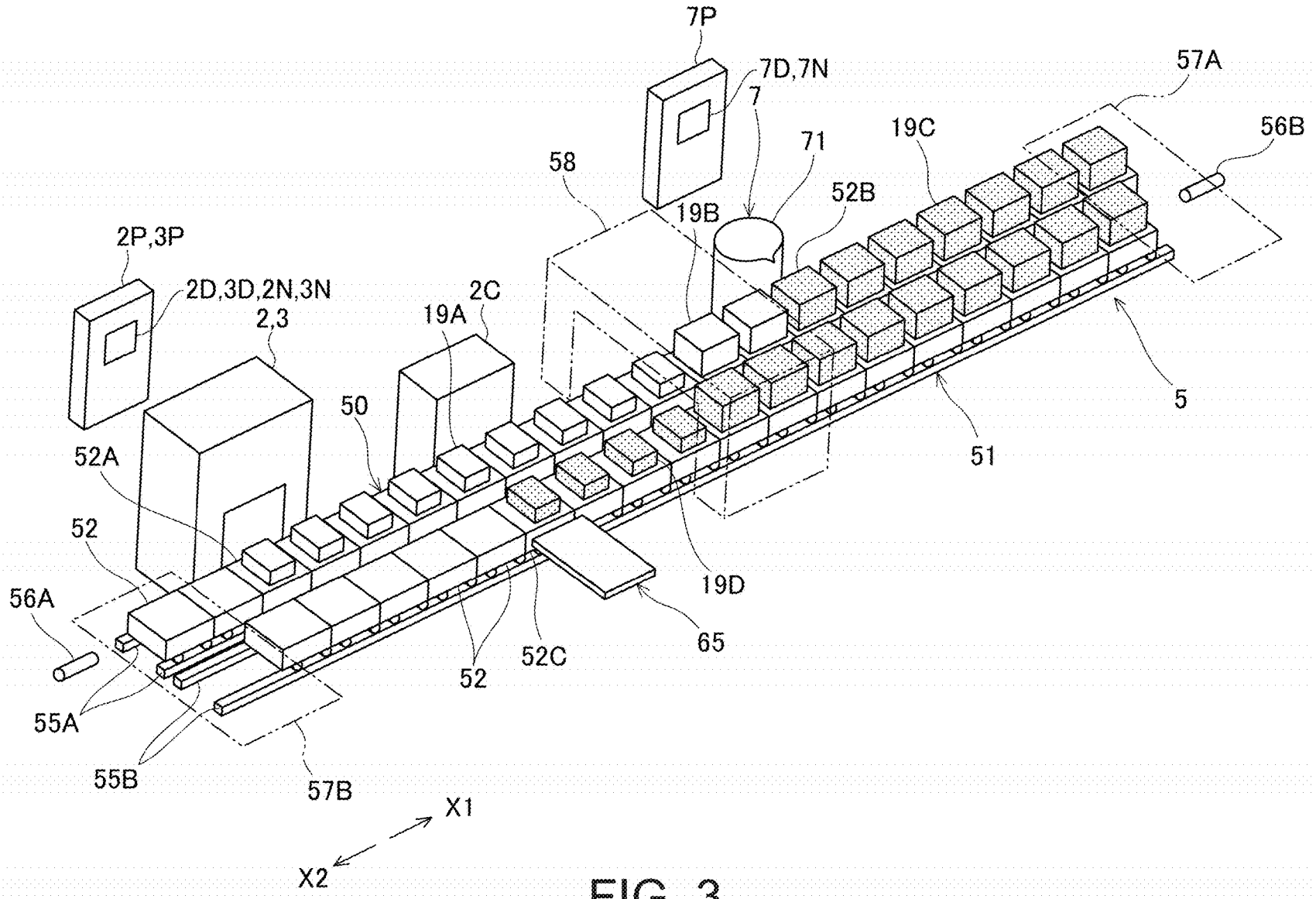
FIG. 3 is a partial enlarged perspective view of the above-mentioned casting equipment.

First, the primary cooling conveyance device 5 and the melt pouring equipment 7 will be explained, then the mold shake-out device 65 and the secondary cooling conveyance device 6 will be explained. FIG. 3 is a perspective view of the casting equipment 1 in the vicinity of the primary cooling conveyance device 5.

The primary cooling conveyance device 5 is provided with a first line 50 and a second line 51.

The first line 50 is provided with a pair of casting mold rails 55A that are adjacent to the molding equipment 2 and that extend in the first direction X1. The second line 51 is provided with a pair of casting mold rails 55B provided substantially parallel to the first line 50, on the side of the first line 50 opposite to the molding equipment 2. On the casting mold rails 55A and the casting mold rails 55B, multiple molding board carts 52 are provided so as to contact each other, as with the first line 50.

The molding board cart 52 on the first line 50 receives casting molds 19A from the molding equipment 2 and convey the casting molds 19A in the first direction X1 by being continually pushed in the first direction X1 by a first pusher 56A provided at the end of the first line 50 in the second direction X2.

A weight transfer device 58 is provided so as to straddle the first line 50 and the second line 51. The weight transfer device 58 removes a weight and a jacket from weight-bearing melt-poured casting molds 19C in which melt has been cast, conveyed over the second line 51, to be explained below, and transfers the weight and jacket to casting molds 19A that have been conveyed over the first line 50.

In FIG. 3, weight-bearing casting molds 19B on which a weight and a jacket have been transferred by the weight transfer device 58 are drawn with a height taller than the casting molds 19A discharged by the molding equipment 2.

The inspection device 2C, which has already been explained, is provided between the molding equipment 2 and the weight transfer device 58 on the first line 50 in the present embodiment.

The molding board cart 52 on weight-bearing casting molds 19B have been placed is conveyed from the weight transfer device 58 and arrives at the melt pouring equipment 7 to be described below. The melt is cast in the weight-bearing casting molds 19B by the melt pouring equipment 7. The weight-bearing casting molds 19B in which the melt has been cast are also called weight-bearing melt-poured casting molds 19C. In FIG. 3, the weight-bearing melt-poured casting molds 19C are indicated by the shapes of the weight-bearing casting molds 19B with a dot pattern.

The molding board cart 52 on which the weight-bearing melt-poured casting molds 19C have been placed arrive at the end of the first line 50 in the first direction X1, and is transferred to the second line 51 by a first traverser 57A.

The molding board cart 52 that has been transferred to the second line 51 conveys the weight-bearing melt-poured casting molds 19C in the second direction X2 by being continually pushed in the second direction X2 by a second pusher 56B provided on an end of the second line 51 in the first direction X1.

On the second line 51, the molding board cart 52 on which the weight-bearing melt-poured casting molds 19C have been placed arrives again at the weight transfer device 58. The weight transfer device 58 removes the weight and the jacket from the weight-bearing melt-poured casting molds 19C and place them on casting molds 19A conveyed on the first line 50. Casting molds in which the melt has been cast and from which the weight and the jacket have been removed are called melt-poured casting molds 19D. In FIG. 3, the melt-poured casting molds 19D are indicated by the shapes of the casting molds 19A with a dot pattern.

The molding board cart 52 on which the melt-poured casting molds 19D have been placed arrives at the mold shake-out device 65. The melt-poured casting mold 19D on the molding board cart 52 that has arrived at the mold shake-out device 65 is transferred to the mold shake-out device 65 by means of a pusher that is not illustrated.

The molding board cart 52 from which the melt-poured casting molds 19D have been transferred to the mold shake-out device 65 and which is no longer carrying anything arrive at the end, in the second direction X2, of the second line 51, and is transferred to the first line 50 by the second traverser 57B.

As described above, each molding board cart 52 moves by a distance equivalent to the length of a single molding board cart 52 at a processing timing instructed by the overall control device 11 to be explained below, basically in the predetermined casting cycle mentioned above, so as to circulate between the first line 50 and the second line 51.

After the melt is cast in casting molds by the melt pouring equipment 7, the casting molds are cooled and solidified over time until the molding board cart 52 on which said casting molds are placed arrives at the mold shake-out device 65.

The melt pouring equipment 7 is provided with a furnace 70, a ladle 71, and an automatic melt pouring device 72.

The furnace 70 is, for example, an induction furnace that melts a metal loaded therein by means of Joule heating. The melt produced by the furnace 70 is received and temporarily kept in the ladle 71 and carried to the automatic melt pouring device 72, which is provided adjacent to the first line 50 of the primary cooling conveyance device 5.

The automatic melt pouring device 72 pours the melt in casting molds 19A that are transported over the first line 50 at a processing timing instructed by the overall control device 11, basically in the predetermined casting cycle mentioned above.

The melt pouring equipment 7 is provided with a control panel (control device) 7P and a timer for measuring the times at which the melt is cast. The timer measures, as a casting time, the time at which the melt was cast in a pair of an upper casting mold and a lower casting mold, and transmits the casting time to the control panel 7P of the melt pouring equipment 7.

The melt pouring equipment 7 is provided with various types of measuring devices that measure the casting weight, the casting time period, the amount of an inoculant that is added, a melt receiving duration, a casting temperature and the like. The control panel 7P of the melt pouring equipment 7 receives these measured values measured by the various types of measuring devices, and transmits the measured values to the overall control device 11 together with a ladle lot number (ladle number) corresponding to the ladle that poured the melt, a material number, and a casting time as specific data, i.e., as melt pouring data, for each casting mold.

The secondary cooling conveyance device 6 is provided with a casting rail multiple suspension devices 61, and a driving unit that is not illustrated. The casting rail 60 is installed so as to be located in mid-air above the molding board carts 52 of the primary cooling conveyance device 5, on the side of the primary cooling conveyance device 5 opposite to the molding equipment 2. The casting rail is formed in the shape of a loop. Each of the multiple suspension devices 61 is provided so as to be suspended from the casting rail 60 at equidistant intervals.

The mold shake-out device 65 is provided between the secondary cooling conveyance device 6 and the second line 51 of the primary cooling conveyance device 5. The mold shake-out device 65 suspends casting 19E produced by said melt-poured casting molds 19D while separating the molding sand forming the melt-poured casting molds 19D from the casting 19E.

Each of the multiple suspension devices 61 illustrated in FIG. 1 is controlled by the control panel 4P of the cooling conveyance equipment 4 so as to be moved by the driving unit along the casting rail 60 in the counterclockwise direction. For this reason, the casting 19E (indicated by the triangles in FIG. 1) that has been hung on the suspension devices 61 by the mold shake-out device 65 moves in the counterclockwise direction together with the suspension devices 61.

The casting 19E arrives at a robot 81 to be explained below, and is removed from the suspension devices 61 by the robot 81. The suspension devices 61 from which the casting 19E has been removed moves further in the counterclockwise direction and arrives back at the mold shake-out device 65, and a casting 19E is hung thereon.

The control panel 4P of the cooling conveyance equipment 4 controls the driving unit so that each suspension device 61 moves over the casting rail 60 by a distance equivalent to the spacing between adjacent suspension devices 61, at a processing timing instructed by the overall control device 11, basically in the predetermined casting cycle mentioned above.

After mold shake-out is performed by the mold shake-out device 65, the casting is cooled over time until the suspension device 61 on which said casting from the casting molds has been suspended arrives at the robot 81.

The cooling conveyance equipment 4 is provided with a timer, which is not illustrated, for measuring the time at which the mold shake-out is performed. The timer measures, as a mold shake-out time, the time at which mold knock-out is performed, and transmits the mold shake-out time to the control panel 4P of the cooling conveyance equipment 4.

Additionally, the timer of the cooling conveyance equipment 4 measures, as a cooling time period, the time period during which each casting has been cooled, and transmits the cooling time period to the control panel 4P of the cooling conveyance equipment 4. The control panel 4P of the cooling conveyance equipment 4 transmits the cooling time period and the mold shake-out time of casting molds to the overall control device 11 as specific data, i.e., as cooling conveyance data, for each casting mold.

The post-treatment equipment 8 is provided with the robot 81, a shot blasting device 82, a conveyor 83, an engraving device 84, and a control panel (control device) 8P.

The robot 81 is, for example, a vertically articulated six-axis robot that picks, from a suspension device 61, casting 19E that has been conveyed by the secondary cooling conveyance device 6. The robot 81 places the casting 19E that has been picked in the shot blasting device 82.

The shot blasting device 82 executes a shot blast treatment on the casting 19E placed by the robot 81. After the shot blast treatment ends, the robot 81 picks up the casting 19E that has been subjected to the shot blast treatment and places it on the conveyor 83.

The casting 19E placed on the conveyor 83 is conveyed in the first direction X1 towards a shipment area 14.

The engraving device 84 engraves, by means of a laser or the like, one of or each of multiple casting products included in the casting 19E conveyed on the conveyor 83. Thereafter, gate-cutting on each casting 19E is performed to form one or more casting products.

On the conveyor 83 downstream from the engraving device 84 or at the shipment area 14, a final inspection is performed on each casting 19E formed by gate-cutting. In the inspection, the casting products are checked regarding their dimensions, the presence or absence of flaws, and the like. The final inspection is performed by an inspection device that is not illustrated, by visual observation by an operator, or the like.

The inspection results of the final inspection on the one or more casting products formed by the respective casting molds are input to the control panel 8P.

The control panel 8P of the post-treatment equipment 8 controls the conveyor 83 so that each of the placement tools on the conveyor 83 moves by a distance equivalent to the spacing between adjacent placement tools, at a processing timing instructed by the overall control device 11, basically in the predetermined casting cycle mentioned above.

The post-treatment equipment 8 is provided with a timer, which is not illustrated, for measuring the time at which engraving was performed. The timer measures, as an engraving time, the time at which a casting was engraved, and transmits the engraving time, together with the type of engraving, to the control panel 8P of the post-treatment equipment 8.

Additionally, the timer in the post-treatment equipment 8 measures, for each casting, the gate-cutting time, which is the time at which gate-cutting is performed. The timer measures, as the gate-cutting time, the time at which gate cutting on a casting is performed, and transmits the gate-cutting time to the control panel 8P of the post-treatment equipment 8.

Furthermore, the control panel 8P can receive inspection results from the final inspection, either from an inspection device that is not illustrated or by an input by an operator to an input device or the like.

The control panel 8P of the post-treatment equipment 8 transmits the gate-cutting time, the engraving time, the engraving type, and the inspection results of the final inspection for each casting to the overall control device 11 as specific data, i.e., as post-treatment data, for each casting.

As illustrated in FIG. 1, a conveyor 101 is provided below the casting rail 60. The molding sand that has been shook out by the mold shake-out device 65 is transported to the sand treatment equipment 10 by the conveyor 101. The sand treatment equipment 10 performs a reclamation treatment on the conveyed molding sand. The conveyor 131 conveys the molding sand that has been treated in the reclamation treatment, to the molding equipment 2.

The sand treatment equipment 10 is provided with a control panel (control device) 10P. The control panel 10P transmits various types of measurement results, such as the sand properties and the measurement times, to the overall control device 11, as specific data, i.e., as sand treatment data, corresponding to the molding sand to be molded into a pair of an upper casting mold and a lower casting mold, at a processing timing instructed by the overall control device 11, basically in the predetermined casting cycle mentioned above.

Next, the operations of the control devices in the present embodiment, i.e., the respective control panels 2P, 3P, 4P, 7P, 8P, and 10P, and the overall control device 11, will be explained using FIGS. 1 to 3 and 4 to 15.

The overall control device (control device) 11 acquires specific data for the casting molds in each frame regarding each of the multiple processes in the casting equipment 1, e.g., the molding process, the core mounting process, the melt pouring process, the cooling conveyance process, the post-treatment process, and the sand treatment process, and associates the specific data for the respective processes with the casting molds, separately for the casting molds in each frame; and, on a display device provided, with respect to a first process among the multiple processes and a second process later than the first process, on equipment for executing the second process, displays the specific data for the first process associated with the casting molds that are to be processed in the second process.

In this case, the sand treatment process is a process for performing a treatment on molding sand that has been recovered from the casting molds to reuse it, and for this reason, the sand treatment process was explained last in the above. However, since the treated molding sand is used for producing casting molds in the molding process and the properties of the molding sand largely affect the quality of the casting molds, in the present embodiment, the sand treatment process is regarded as a process earlier than the molding process.

Additionally, regarding the molding process and the core mounting process, since the casting molds are produced by the molding process and the cores are provided therein, the core mounting process is, in fact, a process following the molding process. However, in the present embodiment, the core mounting equipment 3 is provided in the molding equipment 2, and therefore, the molding process and the core mounting process are performed simultaneously and there will be no difference in terms of which comes earlier or later.

Furthermore, regarding the melt pouring process and the cooling conveyance process, since the casting molds that have been produced by the molding process are conveyed, while the cooling conveyance process, to the melt pouring equipment 7 that executes the melt pouring process, and are further conveyed by the cooling conveyance process after the melt has been poured, a distinction cannot, in fact, be made between these processes in terms of which comes earlier or later. However, in the present embodiment, the cooling conveyance process will be regarded as a process that is later than the melt pouring process, in that the cooling conveyance process is a process for conveying the casting molds and cooling the melt that has been poured in the melt pouring process.

The molding equipment 2, the core mounting equipment 3, the cooling conveyance equipment 4, the melt pouring equipment 7, the post-treatment equipment 8, and the sand treatment equipment 10 are each provided with an input device 2N, 3N, 4N, 7N, 8N, or 10N, and a display device 2D, 3D, 4D, 7D, 8D, or 10D. More specifically, the control panel 2P, 3P, 4P, 7P, 8P, or 10P on each of the molding equipment 2, the core mounting equipment 3, the cooling conveyance equipment 4, the melt pouring equipment 7, the post-treatment equipment 8, and the sand treatment equipment 10 is provided with an input device 2N, 3N, 4N, 7N, 8N, or 10N, and a display device 2D, 3D, 4D, 7D, 8D, or 10D, respectively, as illustrated in FIG. 2. In the present embodiment, the display devices 2D, 3D, 4D, 7D, 8D, and 10D are display panels, and the input devices 2N, 3N, 4N, 7N, 8N, and 10N are touch panels provided on the display panels.

As mentioned above, in the present embodiment, the control panel 3P of the core mounting equipment 3 is the same as the control panel 2P of the molding equipment 2. Therefore, the input device 3N and the display device 3D of the core mounting equipment 3 are the same as the input device 2N and the display device 2D of the molding equipment 2.

The present embodiment has a configuration in which there are provided the overall control device 11 and the respective control panels 2P, 3P, 4P, 7P, 8P, and as control devices for controlling the respective devices and equipment, such that the overall control device 11 controls the entire casting equipment 1 and, under this control, the respective control panels 2P, 3P, 4P, 7P, 8P, and 10P control the molding equipment 2, the core mounting equipment 3, the cooling conveyance equipment 4, the melt pouring equipment 7, the post-treatment equipment 8, and the sand treatment equipment 10, respectively. However, the overall control device 11 and the respective control panels 2P, 3P, 4P, 7P, 8P, and 10P cooperate as a whole to control the casting equipment 1, and from this viewpoint, the control panels 2P, 3P, 4P, 7P, 8P, and 10P, and the overall control device 11 can be considered, as a whole, to be a single control device for controlling the casting equipment 1.

That is, instead of the configuration mentioned above, for example, the control device may be provided with only the overall control device 11. In this case, the overall control device 11 is configured to also perform the functions of the respective control panels 2P, 3P, 4P, 7P, 8P, and 10P, the respective control panels 2P, 3P, 4P, 7P, 8P, and 10P are omitted, and the molding equipment 2, the core mounting equipment 3, the cooling conveyance equipment 4, the melt pouring equipment 7, the post-treatment equipment 8, and the sand treatment equipment 10 are each not provided with an individual control mechanism, and are only provided with the display devices 2D, 3D, 4D, 7D, 8D, and 10D, and the input devices 2N, 3N, 4N, 7N, 8N, and 10N.

Alternatively, the control device may be provided with only the control panels 2P, 3P, 4P, 7P, 8P, and 10P. In this case, the casting equipment 1 does not have the overall control device 11, and the control panels 2P, 3P, 4P, 7P, 8P, and 10P are configured to cooperate to perform the function of the overall control device 11 in the present embodiment.

Thus, the control device is not limited to the configuration explained in the present embodiment, and may have various configurations. That is, in the explanation below, in the case in which the overall control device 11 or the respective control panels 2P, 3P, 4P, 7P, 8P, and 10P are described as executing certain processes, this may include the case in which the control device including these as a whole executes the respective processes.

The overall control device 11 measures out a predetermined casting cycle of, for example, 40 seconds. In each predetermined casting cycle, the overall control device 11 transmits, to the molding equipment 2, the core mounting equipment 3, the cooling conveyance equipment 4, the melt pouring equipment 7, the post-treatment equipment 8, and the sand treatment equipment 10, instructions regarding, for example, a processing timing at which an operation is to be started in each equipment, or a measurement timing at which specific data is to be sent from the control panels 2P, 3P, 4P, 7P, 8P, and 10P of the respective equipment to the overall control device 11.

The overall control device 11 holds the times at which such processing timings and measurement timings were transmitted.

The overall control device 11 receives, from the control panel 2P of the molding equipment 2, a molding time, molding cast data, and mold shift inspection results by the inspection device 2C, as specific data for the molding equipment 2 regarding each casting mold. The overall control device 11 receives, from the control panel 3P of the core mounting equipment 3, core data as specific data for the core mounting equipment 3 regarding each casting mold. The overall control device 11 receives, from the control panel 7P of the melt pouring equipment 7, melt pouring data as specific data for the melt pouring equipment 7 regarding each casting mold. The overall control device 11 receives, from the control panel 4P of the cooling conveyance equipment 4, cooling conveyance data as specific data for the cooling conveyance equipment 4 regarding each casting mold. The overall control device 11 receives, from the control panel 8P of the post-treatment equipment 8, post-treatment data as specific data for the post-treatment equipment 8 regarding each casting mold. The overall control device 11 receives, from the control panel 10P of the sand treatment equipment 10, sand treatment data as specific data for the sand treatment equipment 10 corresponding to the molding sand for casting molds in each frame, i.e., molded into a pair of an upper casting mold and a lower casting mold that have been matched together.

The overall control device 11 receives the various types of data mentioned above from the respective equipment, and associates the specific data of the respective processes with the casting molds in each frame in the manner indicated below.

Figure 4:
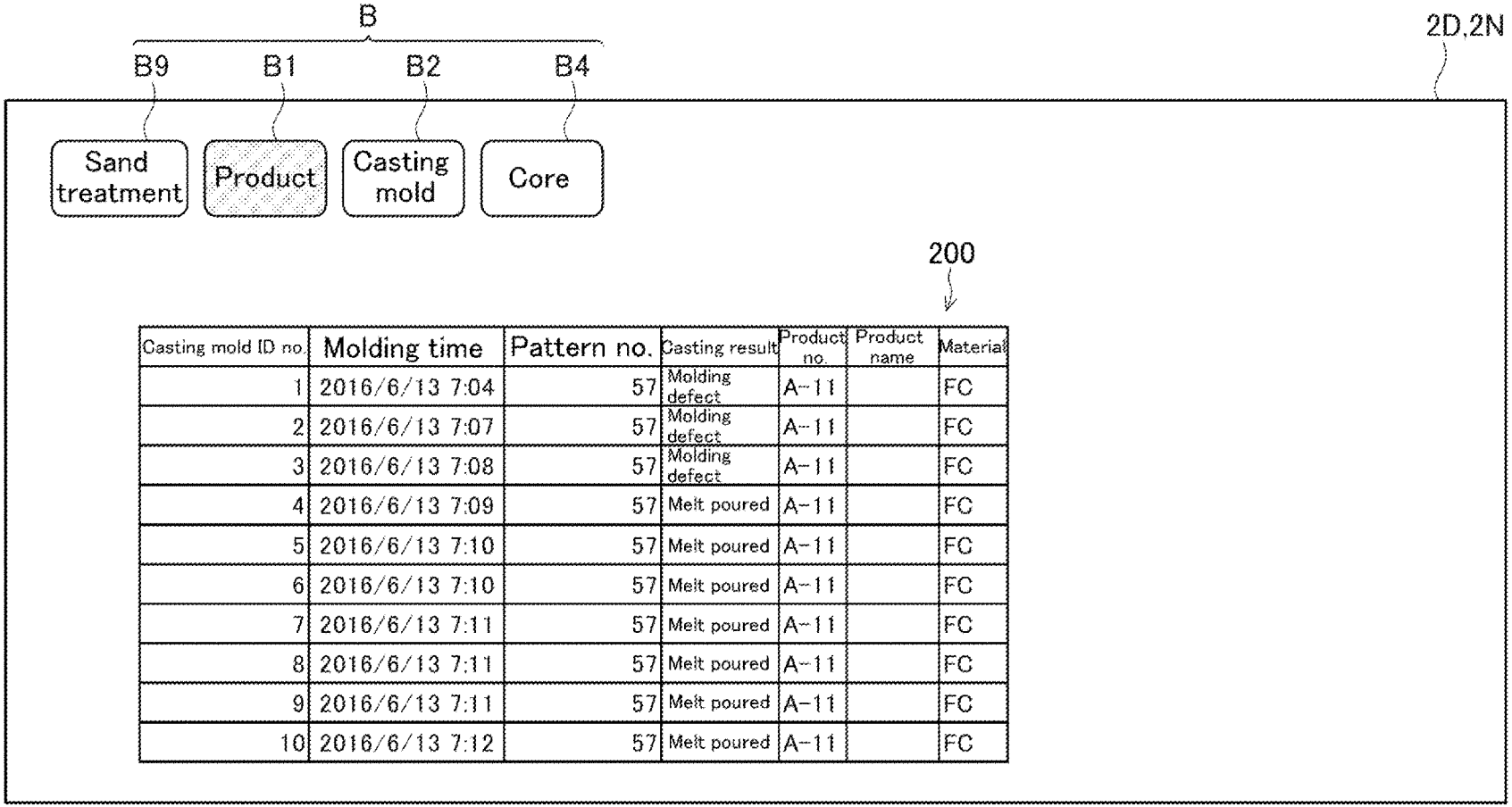
FIG. 4 is an explanatory diagram of a screen on a display device displaying a product information table stored in a control device for the above-mentioned casting equipment.

The overall control device 11 holds the product information table 200 depicted in FIG. 4. The product information table 200 is a table for managing the respective casting molds that have been molded, in which product data including a molding time, a pattern number, casting results, a product number, a product name, and a material are associated with each casting mold.

Every time a molding time and casting mold data for each casting mold that has been molded are received from the molding equipment 2, the overall control device 11 issues a casting mold identification number specific to the molded casting mold, adds a line corresponding to this new casting mold to the product information table 200, and in each box in the added line, registers the issued casting mold identification number, the molding time, the pattern number, the product number, the product name, and the material. In the column for the casting results in the product information table 200, information is input regarding whether or not, during the melt pouring process, the casting mold of interest had a molding defect and the melt could not be poured, or the casting mold was normally molded and the melt was poured. That is, a value is not actually entered in the column for the casting results immediately after the casting mold has been produced by the molding process.

The above-mentioned product data includes the number of a pattern used for molding. Therefore, in the present embodiment, the product data is regarded as specific data for the molding process.

Figure 5:
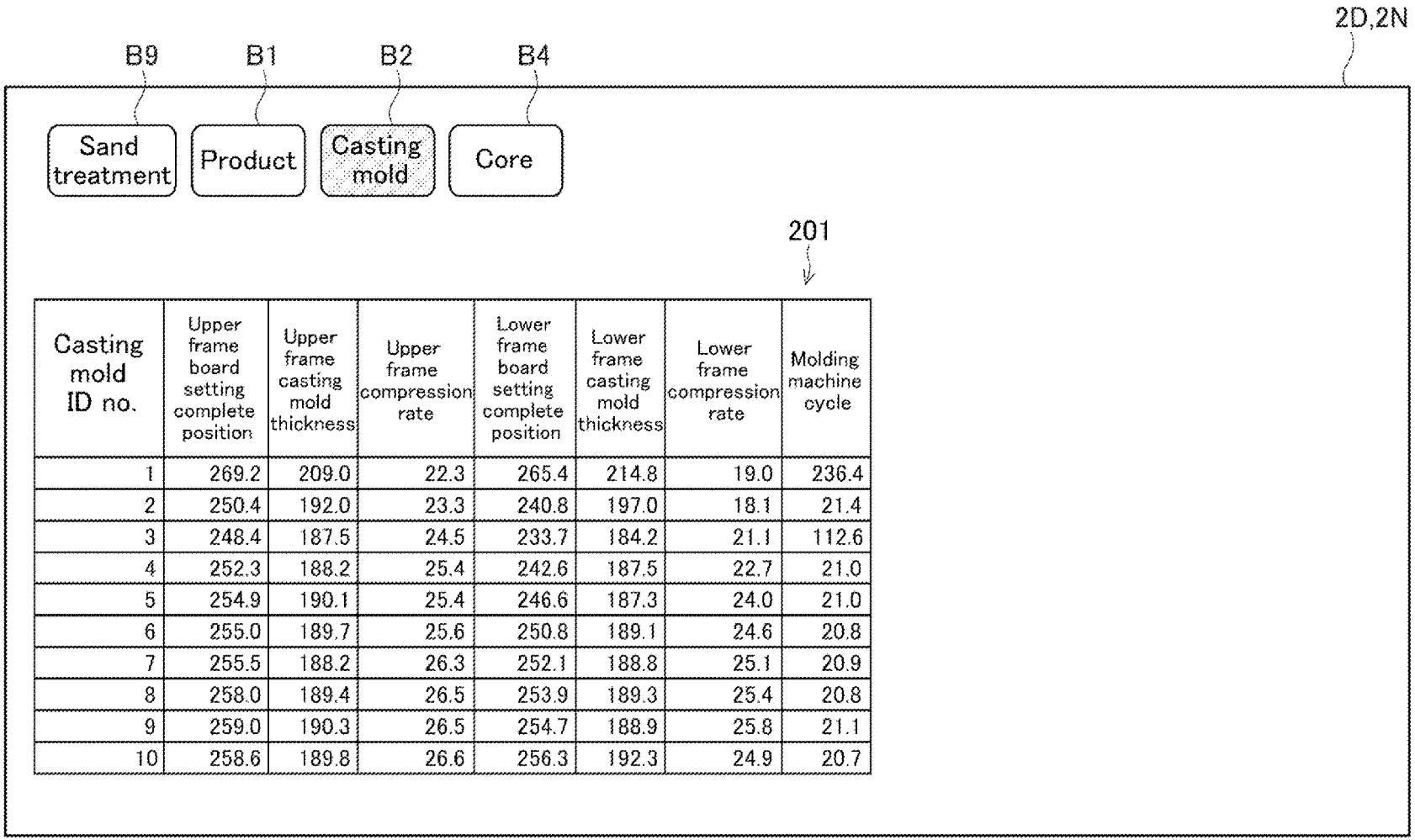
FIG. 5 is an explanatory diagram of a screen on a display device displaying a casting data table stored in the above-mentioned control device.

The overall control device 11 holds the casting mold data table 201 depicted in FIG. 5. The casting mold data table 201 is a table for managing production history data for the respective casting molds that have been molded, in which the casting mold data are each associated with respective casting molds.

When a casting mold identification number is issued and a line corresponding to a new casting mold is added to the product information table 200, the overall control device 11 also adds a line corresponding to the new casting mold to the casting mold data table 201, and in each box in the added line, registers the issued casting mold identification number and the casting mold data received from the molding equipment 2.

Furthermore, the overall control device 11 registers, in association with the issued molding cast identification number, inspection results regarding mold shift by the inspection device 2C, from the molding equipment 2.

The overall control device 11 transmits the product information table 200 and the casting mold data table 201 to the control panels 2P, 3P, 4P, 7P, and 8P, corresponding to the molding process and the core process, and to the melt pouring process, the cooling conveyance process, and the post-treatment process, which are processes later than the former. These control panels 2P, 3P, 4P, 7P, and 8P can display the product information table 200 and the casting mold data table 201 that have been received on the display devices 2D, 3D, 4D, 7D, and 8D, respectively.

For example, FIG. 4 and FIG. 5 are examples in which the product information table 200 and the casting mold data table 201 that have been received from the overall control device 11 are displayed on the display device 2D in the control panel 2P of the molding equipment 2, respectively. The display device 2D displays buttons B together with the product information table 200 and the casting mold data table 201. The buttons B include a product button B1, a casting mold button B2, a core button B4, and a sand treatment button B9.

The display device 2D of the molding equipment 2 displays a sand treatment button B9 corresponding to the sand treatment process, which is a process earlier than the molding process, a product button B1 corresponding to said molding process, and a casting mold button B2. Additionally, in the present embodiment, a core button B4 is also displayed on the display device 2D of the molding equipment 2, since the molding process and the core mounting process are performed simultaneously.

When the product button B1 or the casting mold button B2 displayed on the display device 2D is selected with the input device 2N of the control panel 2P, a product information table 200 and a casting mold data table 201 corresponding thereto are displayed, respectively, as depicted in FIG. 4 and FIG. 5.

In order to make it possible to easily recognize which table is currently being displayed on the display device 2D, the selected button B is displayed so as to be different from the other buttons B, for example, by being filled with a dot pattern.

Figure 6:
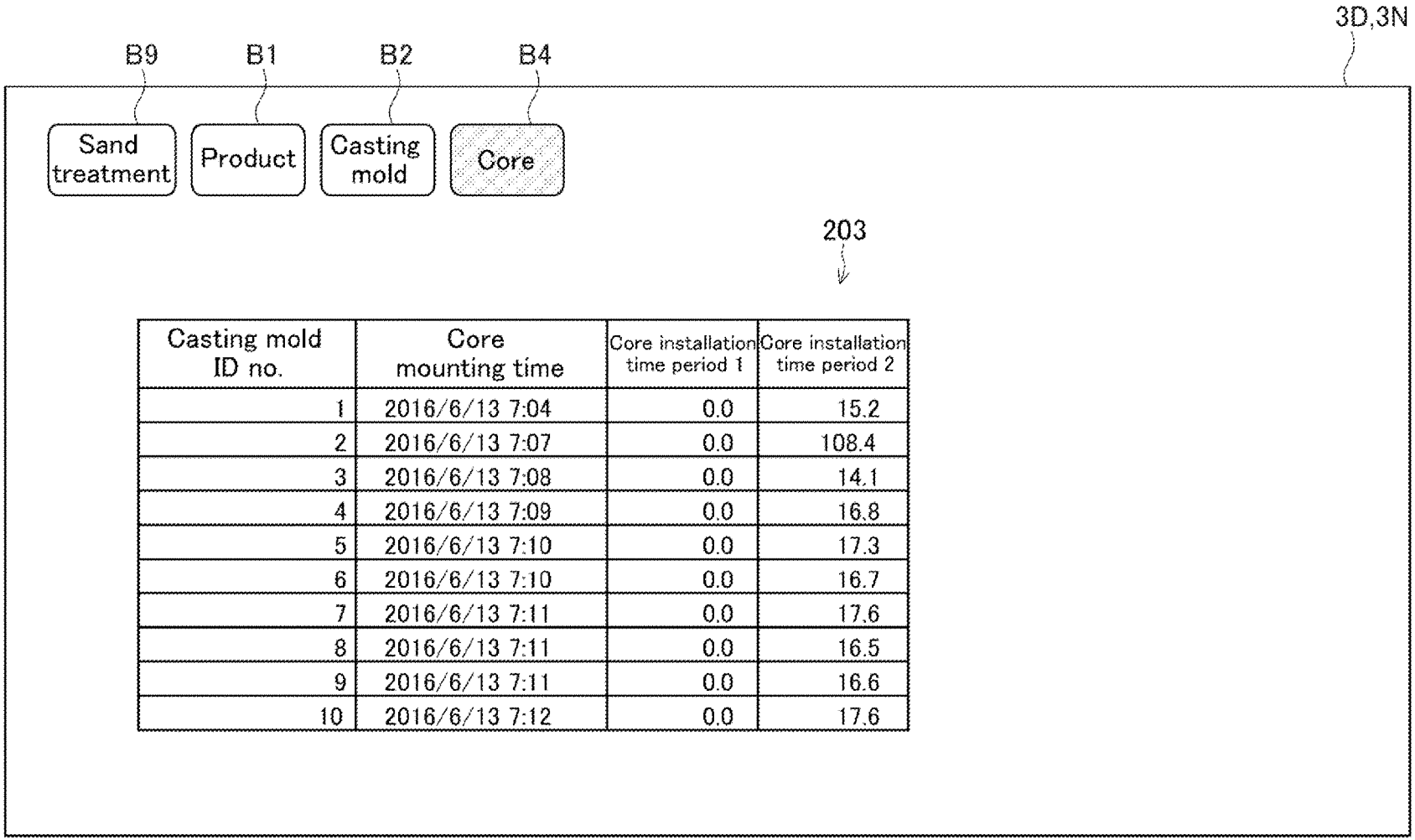
FIG. 6 is an explanatory diagram of a screen on a display device displaying a core data table stored in the above-mentioned control device.

The overall control device 11 holds the core data table 203 depicted in FIG. 6. The core data table 203 is a table for managing core data relating to the cores, in which the core data are each associated with respective casting molds.

In the present embodiment, since the core mounting equipment 3 is provided in the molding equipment 2, the elapsed time between the time at which a core is installed inside casting molds in the core mounting equipment 3 and the time that is stamped as the molding time when said casting molds are considered to have been molded in the molding equipment 2 is substantially constant. Therefore, the overall control device 11 can acquire a casting mold identification number corresponding to a casting mold at which a core was installed at a core mounting time received from the control panel 3P of the core mounting equipment 3, based on the differences between the received core mounting time and the molding time registered in the product information table 200.

Every time core data is received from the core mounting equipment 3, the overall control device 11 adds a line corresponding to a new casting mold to the core data table 203, and registers the casting mold identification number acquired in the manner described above, and each of the core data received from the core mounting equipment 3, in each box in this added line.

The overall control device 11 transmits the core data table 203 to the control panels 2P, 3P, 4P, 7P, and 8P, corresponding to the molding process and the core process, and to the melt pouring process, the cooling conveyance process, and the post-treatment process, which are processes later than the former. These control panels 2P, 3P, 4P, 7P, and 8P display the received core data table 203 on the display device 2D, 3D, 4D, 7D, or 8D, respectively, for example, as depicted in FIG. 6, when the core button B4 is selected with the input device 2N, 3N, 4N, 7N, or 8N.

In this way, by issuing a casting mold identification number to each casting mold that has been molded and associating the casting mold identification number with the specific data for the molding process, the overall control device 11 associates with the casting molds, separately for the casting molds in each frame, the specific data for the molding process relating to the casting molds in each frame.

Additionally, by associating a casting mold identification number with the specific data for the core mounting process, the overall control device 11 associates with the casting molds, separately for the casting molds in each frame, the specific data for the core mounting process relating to the casting molds in each frame.

When the sand treatment button B9 corresponding to the sand treatment process (first process), which is a process earlier than the molding process and the core mounting process (second processes), is selected on the display devices 2D, 3D of the molding equipment 2 and the core mounting equipment 3, specific data for the sand treatment process associated with the casting molds that are to be processed in the molding process and the core mounting process, which are processes later than the sand treatment process, relating to the molding sand used when producing said casting molds, is displayed in a manner similar to that to be explained below using FIG. 13.

Figure 7:
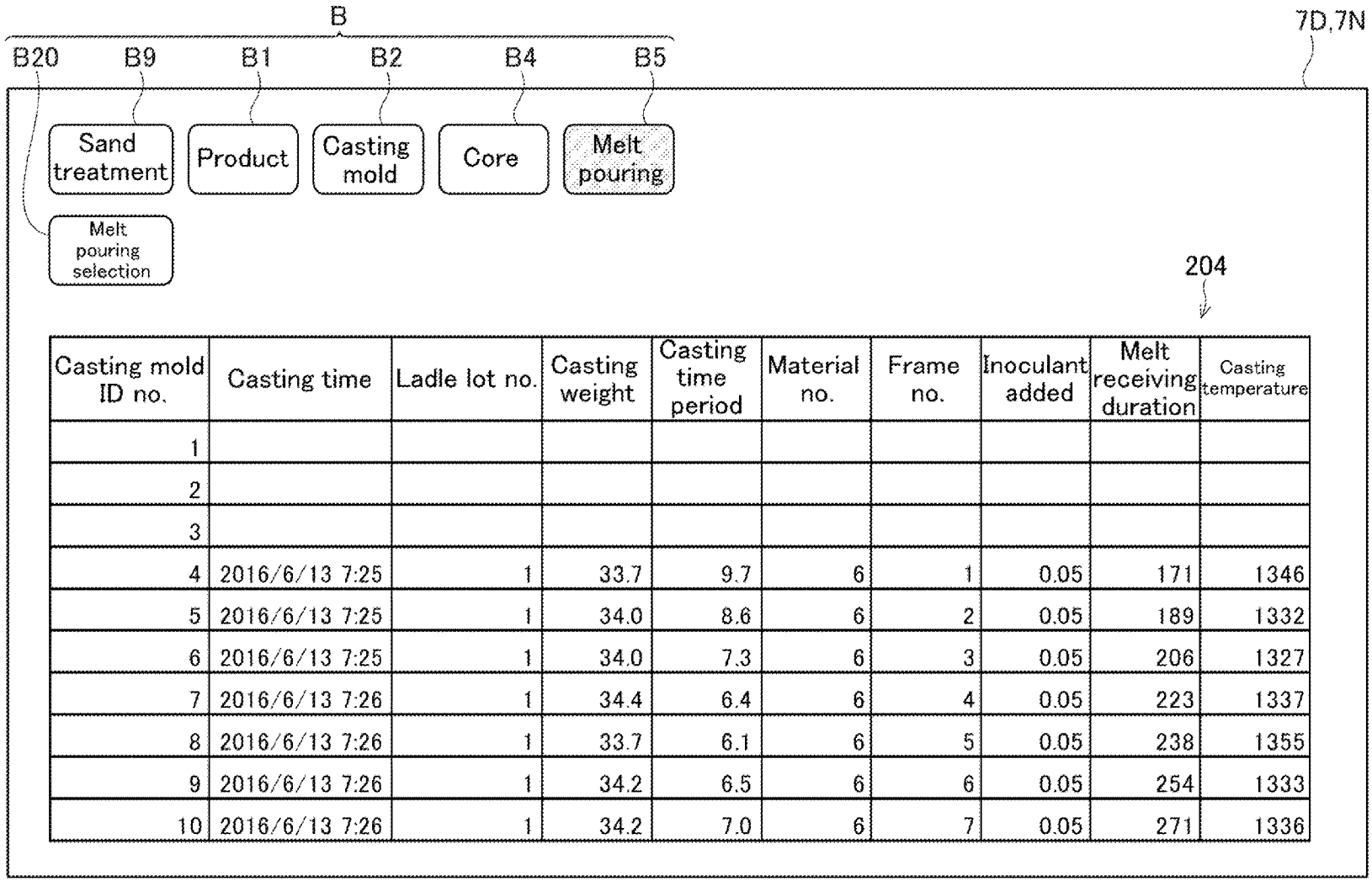
FIG. 7 is an explanatory diagram of a screen on a display device displaying a melt data table stored in the above-mentioned control device.

The overall control device 11 holds the melt pouring data table 204 depicted in FIG. 7. The melt pouring data table 204 is a table for managing melt pouring data relating to melt pouring, in which the melt pouring data are each associated with respective casting molds.

As illustrated in FIG. 1 and FIG. 3, in the present embodiment, the position 52A of the molding board cart 52 at which the casting molds are discharged from the molding equipment 2 and the position 52B of the molding board cart 52 at which the melt is poured into the casting molds by the melt pouring equipment 7 are preset, and the number of molding board carts 52 between the position 52A and the position 52B is also fixed. For this reason, if the time at which a certain specific molding board cart 52 was located at the position 52B is known, then from a processing timing corresponding thereto, the time at which it was located at the position 52A can be estimated based on the time of transmission of a processing timing that is a certain number of processing timings earlier, the number being equivalent to the number of molding board carts 52 between the position 52A and the position 52B. That is, the overall control device 11 estimates, from a casting time received from the control panel 7P of the melt pouring equipment 7, the time at which the molding board cart 52 on which the relevant casting mold has been placed was located at the position 52A, and by comparing said time with the molding times registered in the product information table 200, acquires the casting mold identification number corresponding to the casting mold having the received casting time as the specific data.

Every time melt pouring data is received from the melt pouring equipment 7, the overall control device 11 adds a line corresponding to new casting mold to the melt pouring data table 204, and registers the casting mold identification number acquired in the manner described above, and each of the melt pouring data received from the melt pouring equipment 7, in each box in this added line.

Additionally, the overall control device 11 registers casting results corresponding to the acquired casting mold registration number in the product information table 200 in accordance with whether or not the melt has been poured into the casting mold.

The buttons B include a melt pouring button B5. For the processes earlier than the melt pouring process, the display device 7D of the melt pouring equipment 7 displays a sand treatment button B9 corresponding to the sand treatment process, a product button B1 and a casting mold button B2 corresponding to the molding process, and a core button B4 corresponding to the core mounting process. The display device 7D also displays a melt pouring button B5 corresponding to the melt pouring process.

The overall control device 11 transmits the melt pouring data table 204 to the control panels 4P, 7P, and 8P corresponding to the melt pouring process, and to the cooling conveyance process and the post-treatment process, which are processes later than the melt pouring process. These control panels 4P, 7P, and 8P display the received melt pouring data table 204 on the display device 4D, 7D, or 8D, respectively, for example, as depicted in FIG. 7, when the melt pouring button B5 is selected with the input device 4N, 7N, or 8N.

Figure 8:
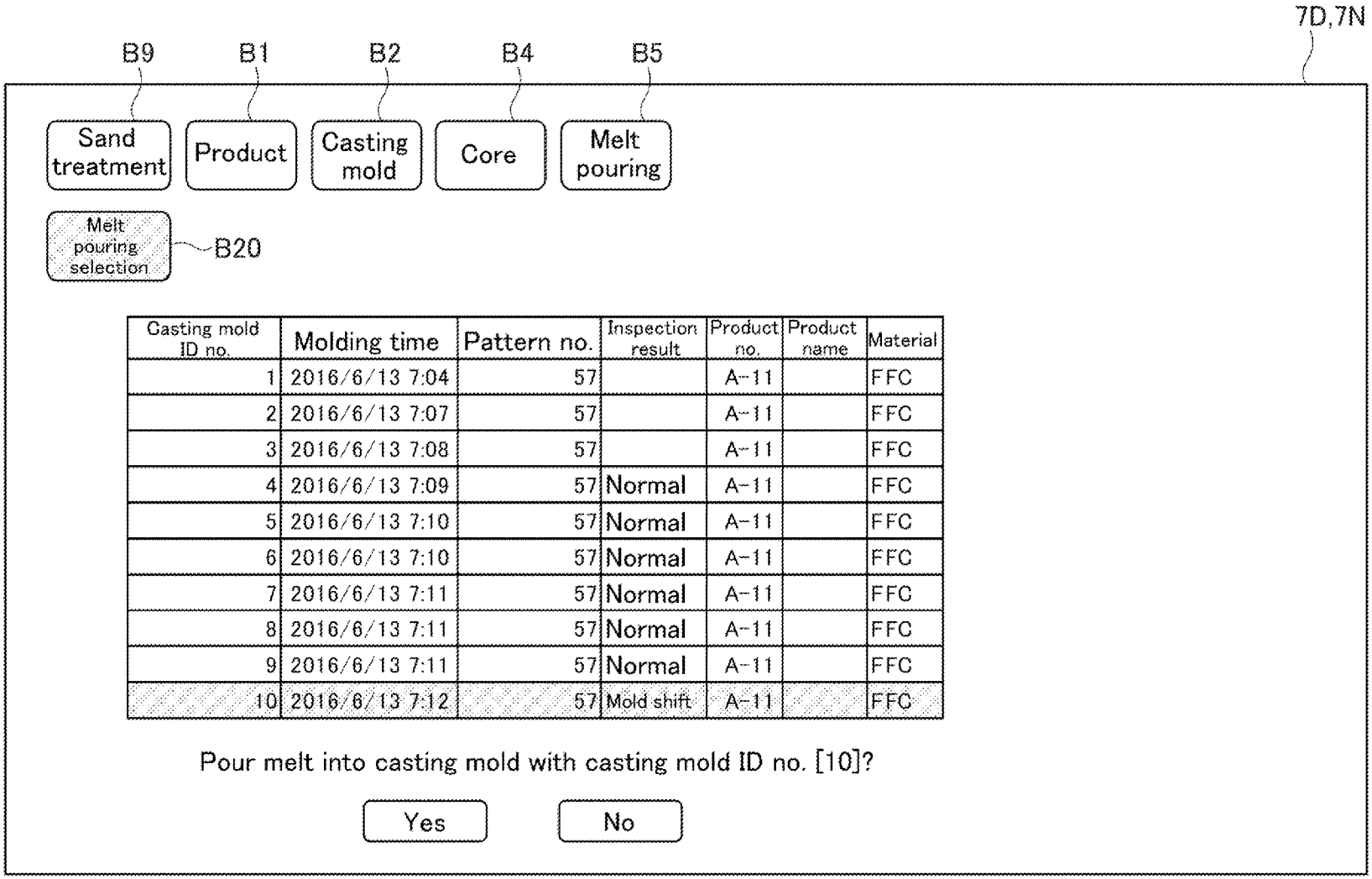
FIG. 8 is an explanatory diagram of a screen for selecting whether or not, during a melt pouring process, the melt is to be poured based on the results of a casting process.

Additionally, as depicted in FIG. 8, the buttons B include a melt pouring selection button B20. On the display panel 7P of the melt pouring equipment 7, the melt pouring selection button B20 is displayed on the display device 7D. By selecting the melt pouring selection button B20 displayed on the display device 7D with the input device 7N of the control panel 7P, part of the product information table 200 and the mold shift inspection results from the inspection device 2C are displayed.

In the case in which mold shift of casting molds 19A has been detected by the inspection device 2C, even if melt is poured into said casting molds 19A, a casting 19E with quality passing the final inspection in the post-treatment process basically cannot be obtained. Therefore, it is conceivable that no melt is to be poured into casting molds 19A at which mold shift has been detected in order to avoid wasting the melt.

To address the situation above, in the present embodiment, as depicted in FIG. 8, by selecting the melt pouring selection button B20 on the control panel 7P of the melt pouring equipment 7, during the melt pouring process, the casting mold identification number of casting molds 19A currently being processed, and the specific data for the molding process corresponding thereto, particularly the mold shift inspection results by the inspection device 2C, are displayed on the display device 7D.

At this time, the display device 7D displays, with respect to casting molds corresponding to casting mold identification numbers for which "Mold shift" was displayed as the inspection result, a message indicating, for example, "Pour melt into casting mold with casting mold ID no. [casting mold ID no.]?", and the buttons "Yes" and "No". The input device 7N is configured in a manner that the input device 7N is able to receive an input regarding whether or not the melt is to be poured into the casting mold that is to be processed next. When "No" is selected by means of this input device 7N, then the melt is not poured into the casting mold corresponding to the relevant casting mold identification number. When "Yes" is selected by means of the input device 7N, then the melt is poured into the casting mold corresponding to the relevant casting mold identification number even if mold shift has been detected.

The display device 7D merely needs to be configured in a manner that at least the casting mold inspection results are displayed as the specific data for the molding process, and thus, a determination can be made regarding whether or not the melt is to be poured.

The result regarding whether or not the melt has been poured in each casting mold is transmitted to the overall control device 11. The overall control device 11 updates the product information table 200 by respectively inputting, to the column for the casting results in the product information table 200, the value "Melt poured" in the case in which the melt has been poured, and the value "Molding defect" in the case in which the melt was not poured. The overall control device 11 transmits the updated product information table 200 to the control panels 2P, 3P, 4P, 7P, and 8P corresponding to the molding process and the core process, and to the melt pouring process, the cooling conveyance process, and the post-treatment process, which are processes later than the former. In FIG. 4, a product information table 200 in which casting result values have been updated in this way is displayed.

As such, by associating casting mold identification numbers with the specific data for the melt pouring process, the overall control device 11 associates with the casting molds 19A, separately for the casting molds in each frame, the specific data for the melt pouring process relating to the casting molds in each frame.

Additionally, when the sand treatment button B9 corresponding to the sand treatment process (first process), which is a process earlier than the melt pouring process (second process), is selected on the display device 7D of the melt pouring equipment 7, specific data for the sand treatment process associated with the casting molds that are to be processed in the melt pouring process, which is a process later than the sand treatment process, relating to the molding sand used when producing said casting molds, is displayed in a manner similar to that to be explained below using FIG. 13.

Additionally, when the product button B1, the casting mold button B2, or the core button B4, corresponding to the molding process and the core mounting process (first processes), which are processes earlier than the melt pouring process (second process), is selected on the display device 7D of the melt pouring equipment 7, specific data for the molding process and the core mounting process, relating to the casting molds that are to be processed in the melt pouring process, which is a process later than the molding process and the core mounting process, is displayed in a manner similar to that explained by using FIG. 4 to FIG. 6.

As such, the control device displays specific data for a first process (for example, the molding process or the core mounting process), associated with a casting mold that is to be processed in a second process (for example, the melt pouring process), on the display device provided on the equipment that is to execute the second process.

Figure 9:
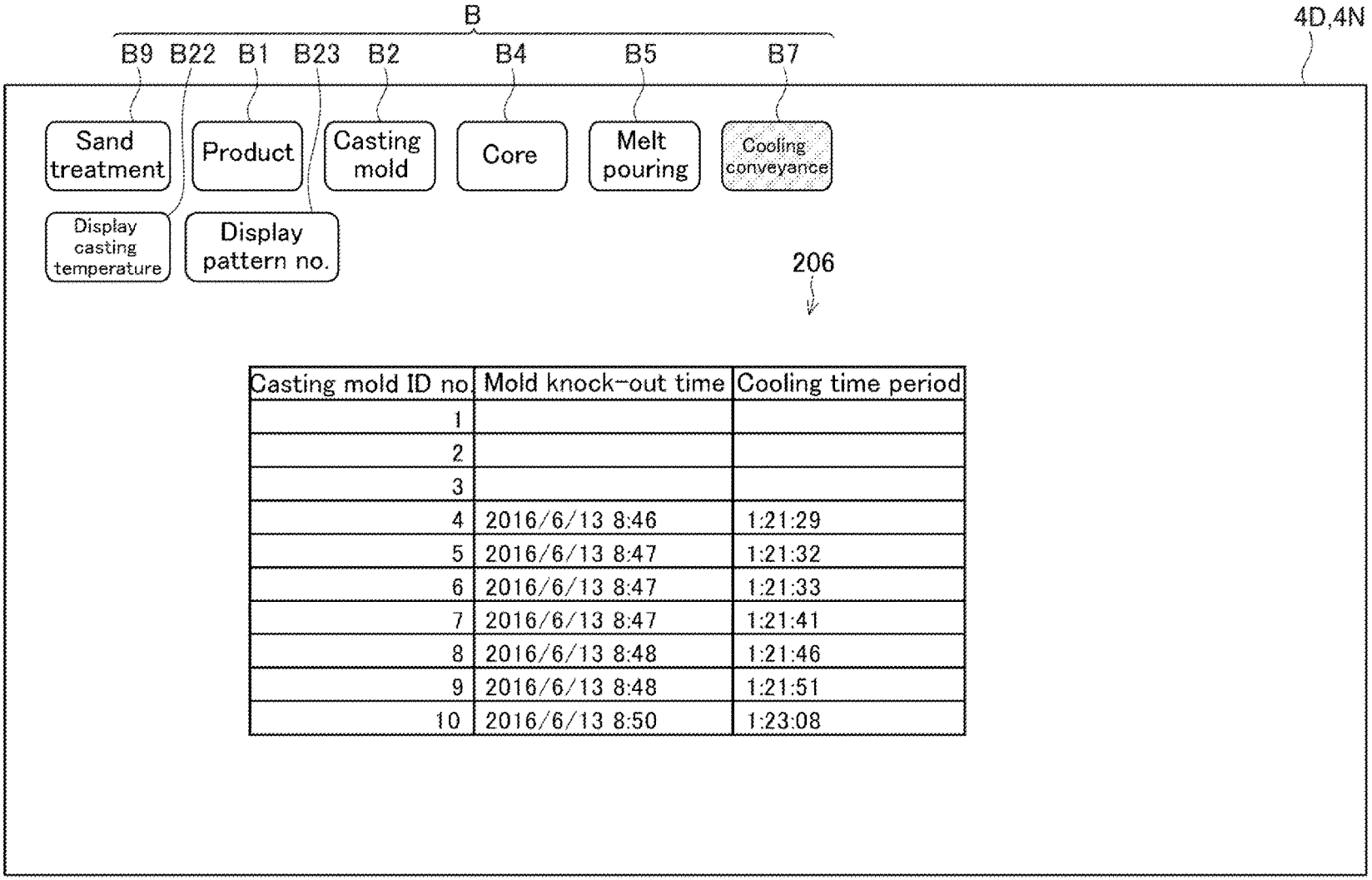
FIG. 9 is an explanatory diagram of a screen on a display device displaying a cooling conveyance data table stored in the above-mentioned control device.

The overall control device 11 holds the cooling conveyance data table 206 depicted in FIG. 9. The cooling conveyance data table 206 is a table for managing cooling conveyance data relating to cooling and conveyance, in which the cooling conveyance data are each associated with respective casting molds.

As illustrated in FIG. 3, in the present embodiment, the position 52A of the molding board cart 52 at which casting molds are discharged from the molding equipment 2 and the position 52C of the molding board cart 52 at which mold shake-out is performed by the mold shake-out device 65 are preset, and the number of molding board carts 52 between the position 52A and the position 52C is also fixed. For this reason, if the time at which a certain specific molding board cart 52 was located at the position 52C is known, then from a processing timing corresponding thereto, the time at which it was located at the position 52A can be estimated based on the time of transmission of a processing timing that is a certain number of processing timings earlier, the number being equivalent to the number of molding board carts 52 between the position 52A and the position 52C. That is, the overall control device 11 estimates, from a mold shake-out time received from the control panel 4P of the cooling conveyance equipment 4, the time at which the molding board cart 52 on which the relevant casting molds has been placed was located at the position 52A, and by comparing said time with the molding times registered in the product information table 200, acquires the casting mold identification number corresponding to the casting molds having the received mold shake-out time as the specific data.

Every time cooling conveyance data is received from the cooling conveyance equipment 4, the overall control device 11 adds a line corresponding to a new casting mold to the cooling conveyance data table 206, and registers the casting mold identification number acquired in the manner described above, and each of the cooling conveyance data received from the cooling conveyance equipment 4, in each box in this added line.

The buttons B include a cooling conveyance button B7. For the processes earlier than the cooling conveyance process, the display device 4D of the cooling conveyance equipment 4 displays a sand treatment button B9 corresponding to the sand treatment process, a product button B1 and a casting mold button B2 corresponding to the molding process, a core button B4 corresponding to the core mounting process, and a melt pouring button B5 corresponding to the melt pouring process. The display device 4D of the cooling conveyance equipment 4 also displays a cooling conveyance button B7 corresponding to the cooling conveyance process.

The overall control device 11 transmits the cooling conveyance data table 206 to the control panels 4P and 8P corresponding to the cooling conveyance process, and to the post-treatment process, which is a process later than the cooling conveyance process. These control panels 4P and 8P display the received cooling conveyance data table 206 on the display device 4D or 8D, for example, as depicted in FIG. 9, when the cooling conveyance button B7 is selected with the input device 4N or 8N.

Figure 10:
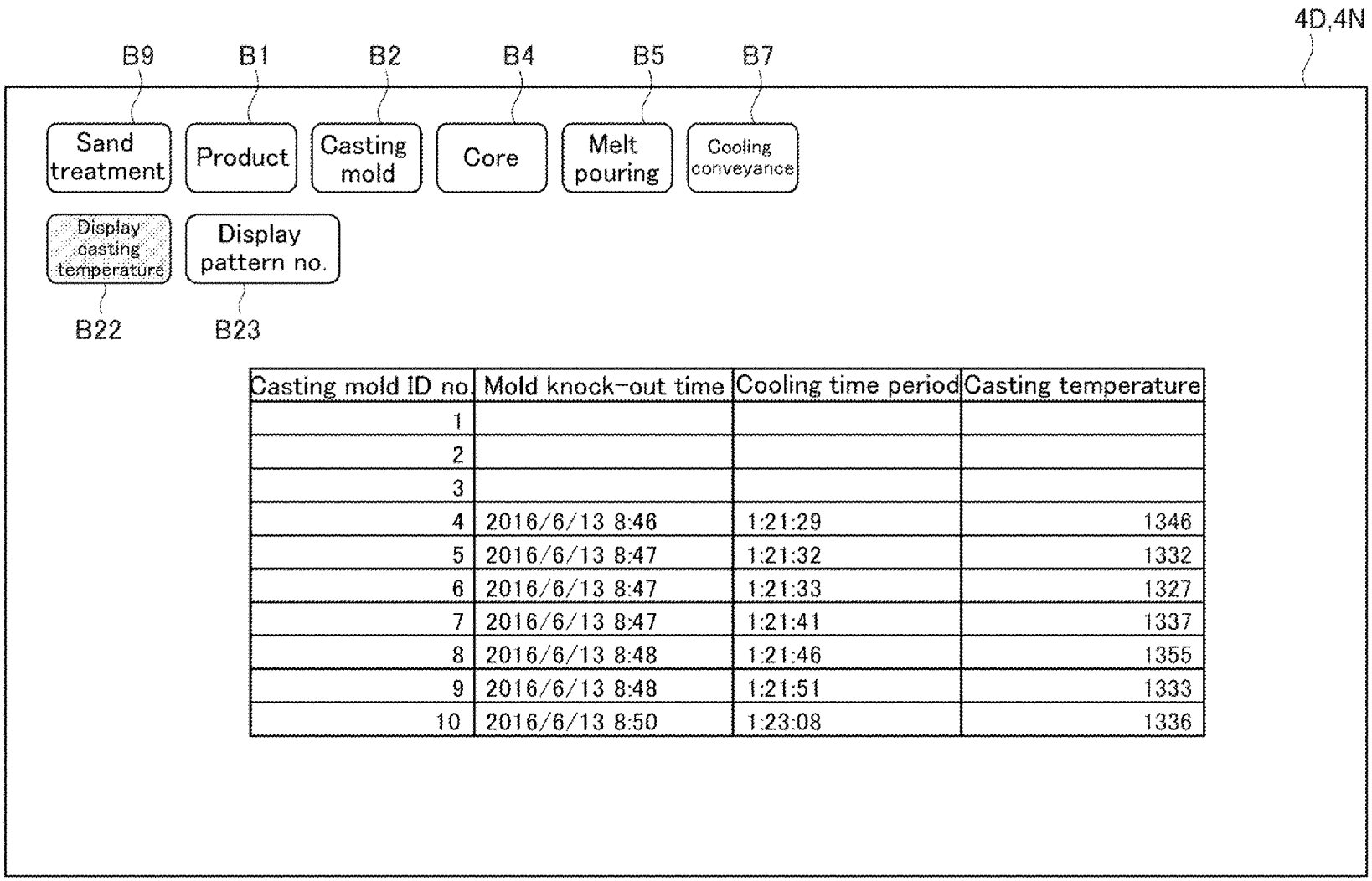
FIG. 10 is an explanatory diagram of a screen on a display device displaying, during a cooling conveyance process, the above-mentioned cooling conveyance data table and casting temperatures of casting molds being conveyed.

Additionally, as depicted in FIG. 10, the buttons B include a casting temperature display button B22. In the control panel 4P of the cooling conveyance equipment 4, a casting temperature display button B22 is displayed on the display device 4D. By selecting the casting temperature display button B22 displayed on the display device 4D with the input device 4N of the control panel 4P, the cooling conveyance data table 206 is displayed together with casting temperatures from the melt pouring data table 204, which contains specific data for the melt pouring process, corresponding to the respective casting mold identification numbers in the cooling conveyance data table 206.

It is sufficient for at least the casting temperature to be displayed as the specific data in the melt pouring process. Additionally, specific data other than the casting temperature may also be displayed.

Figure 11:
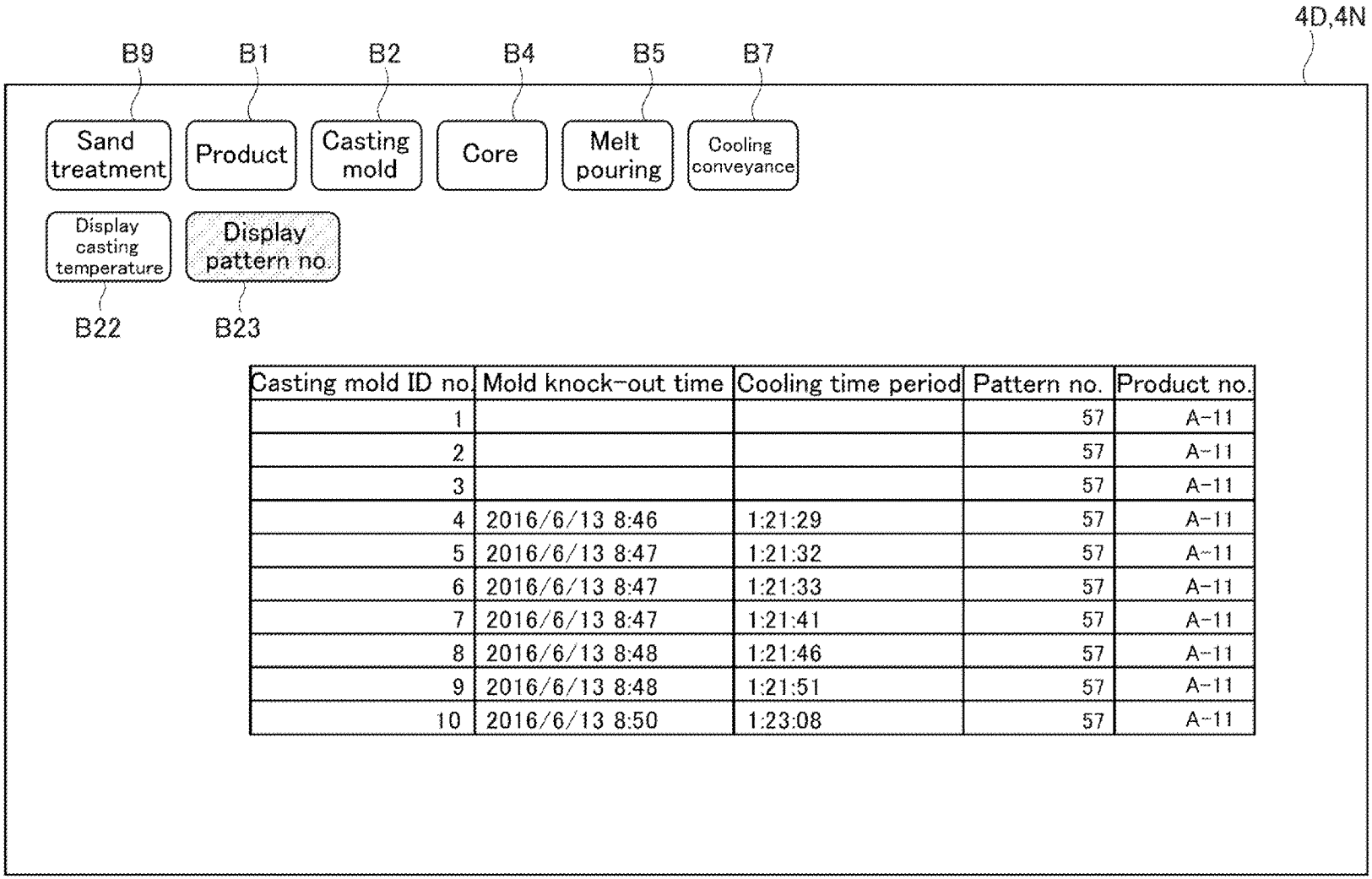
FIG. 11 is an explanatory diagram of a screen on a display device displaying, during a cooling conveyance process, the above-mentioned cooling conveyance data table and pattern numbers and product numbers of casting molds being conveyed.

Furthermore, as depicted in FIG. 11, the buttons B include a pattern number display button B23. In the control panel 4P of the cooling conveyance equipment 4, a pattern number display button B23 is displayed on the display device 4D. By selecting the pattern number display button B23 displayed on the display device 4D with the input device 4N of the control panel 4P, the cooling conveyance data table 206 is displayed together with pattern numbers and product numbers from the product information table 200, which contains specific data for the molding process, corresponding to the respective casting mold identification numbers in the cooling conveyance data table 206.

It is also possible to have only the pattern numbers or the product numbers corresponding to the casting mold identification numbers be displayed when the pattern number display button B23 is selected.

As such, by associating casting mold identification numbers with cooling conveyance data, which is the specific data for the cooling conveyance process, the overall control device 11 associates with the casting molds 19A, the weight-bearing casting molds 19B, the weight-bearing melt-poured casting molds 19C, the melt-poured casting molds 19D, and the casting 19E, which are conveyed during the cooling conveyance process, separately for the casting molds in each frame, the specific data for the cooling conveyance process relating to the casting molds in each frame. That is, associated with the casting molds 19A, the weight-bearing casting molds 19B, the weight-bearing melt-poured casting molds 19C, the melt-poured casting molds 19D, and the casting 19E corresponding to casting molds in the same frame is the same specific data, corresponding to said casting molds.

When the sand treatment button B9 corresponding to the sand treatment process (first process), which is a process earlier than the cooling conveyance process (second process), is selected on the display device 4D of the cooling conveyance equipment 4, specific data for the sand treatment process associated with the casting molds that are to be processed in the cooling conveyance process, which is a process later than the sand treatment process, relating to the molding sand used when producing said casting molds, is displayed in a manner similar to that to be explained below using FIG. 13.

Additionally, when the product button B1, the casting mold button B2, the core button B4, or the melt pouring button B5, corresponding to the molding process, the core mounting process, and the melt pouring process (first processes), which are processes earlier than the cooling conveyance process (second process), is selected on the display device 4D of the cooling conveyance equipment 4, specific data for the molding process, the core mounting process, and the melt pouring process, relating to the casting molds that are to be processed in the cooling conveyance process, which is a process later than the molding process, the core mounting process, and the melt pouring process, is displayed in a manner similar to that explained by using FIG. 4 to FIG. 7.

As such, the control device displays specific data for a first process (for example, the molding process, the core mounting process, or the melt pouring process), associated with a casting mold that is to be processed in a second process (for example, the cooling conveyance process), on the display device provided on the equipment that is to execute the second process.

Figure 12:
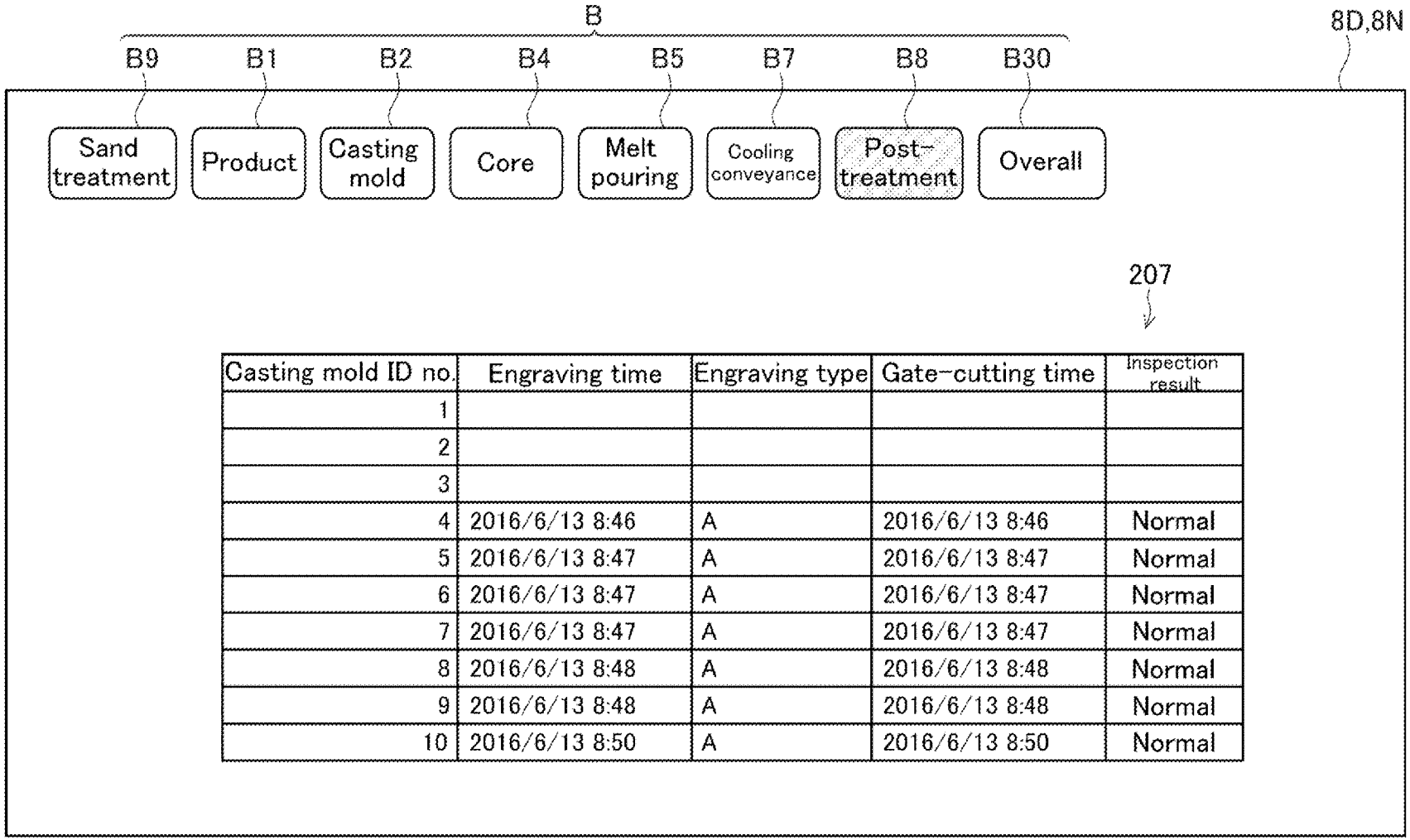
FIG. 12 is an explanatory diagram of a screen on a display device displaying a post-treatment data table stored in the above-mentioned control device.
Figure 15:
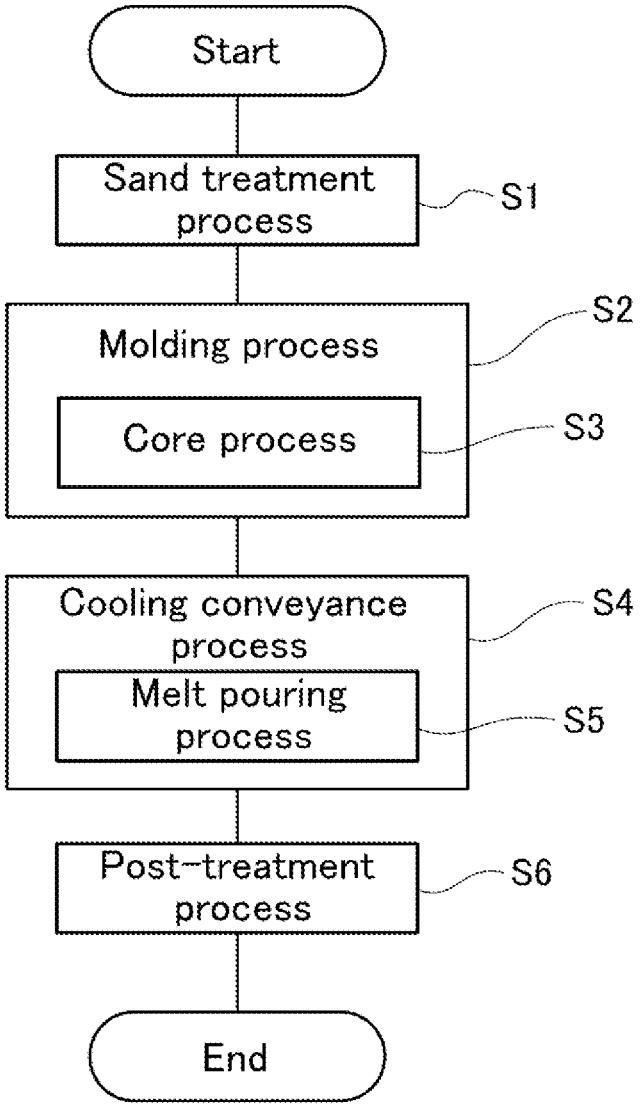
FIG. 15 is a flow chart for a casting method executed by the above-mentioned casting equipment.

The overall control device 11 holds the post-treatment data table 207 depicted in FIG. 12. The post-treatment data table 207 is a table for managing post-treatment data relating to post-treatment, in which the post-treatment data are each associated with respective casting molds.

As illustrated in FIG. 1, in the present embodiment, the position 52A of the molding board cart 52 at which casting molds are discharged from the molding equipment 2 and the position 83D of the placement tool at which the casting removed from said casting molds are engraved by the engraving device 84 are preset, and the number of molding board carts 52, suspension devices 61, and placement tools on the conveyor 83 between the position 52A and the position 83D is also fixed. For this reason, if the time at which a certain molding board cart 52 was located at the position 83D is known, then from a processing timing corresponding thereto, the time at which it was located at the position 52A can be estimated based on the time of transmission of a processing timing that is a certain number of processing timings earlier, the number being equivalent to the number of molding board carts 52, suspension devices 61, and placement tools between the position 52A and the position 83D. That is, the overall control device 11 estimates, from an engraving time received from the control panel 8P of the post-treatment equipment 8, the time at which the molding board cart 52 on which corresponding casting molds have been placed was located at the position 52A, and by comparing said time with the molding times registered in the product information table 200, acquires the casting mold identification number corresponding to the casting molds having the received mold shake-out time as specific data.

Every time post-treatment data is received from the post-treatment equipment 8, the overall control device 11 adds a line corresponding to a new casting mold to the post-treatment data table 207, and registers the casting mold identification number acquired in the manner described above, and each of the post-treatment data received from the post-treatment equipment 8, in each box in this added line.

The buttons B include a post-treatment button B8 and an overall button B30. For the processes earlier than the post-treatment process, the display device 8D of the post-treatment equipment 8 displays a sand treatment button B9 corresponding to the sand treatment process, a product button B1 and a casting mold button B2 corresponding to the molding process, a core button B4 corresponding to the core mounting process, a melt pouring button B5 corresponding to the melt pouring process, and a cooling conveyance button B7 corresponding to the cooling conveyance process. The display device 8D of the post-treatment equipment 8 also displays a post-treatment button B8 corresponding to the post-treatment process.

The overall control device 11 transmits the post-treatment data table 207 to the control panel 8P corresponding to the post-treatment process. The control panel 8P displays the received post-treatment data table 207 on the display device 8D, for example, as depicted in FIG. 12, when the post-treatment button B8 is selected with the input device 8N.

The overall button B30 will be explained below.

As such, by associating casting mold identification numbers with specific data for the post-treatment process, the overall control device 11 associates with the casting 19E, separately for the casting molds in each frame, the specific data for the post-treatment process relating to the casting molds in each frame.

When the sand treatment button B9 corresponding to the sand treatment process (first process), which is a process earlier than the post-treatment process (second process), is selected on the display device 8D of the post-treatment equipment 8, specific data for the sand treatment process associated with the casting molds that are to be processed in the post-treatment process, which is a process later than the sand treatment process, relating to the molding sand used when producing said casting molds, is displayed in a manner similar to that to be explained below using FIG. 13.

Additionally, when the product button B1, the casting mold button B2, the core button B4, the melt pouring button B5, or the cooling conveyance button B7 corresponding to the molding process, the core mounting process, the melt pouring process, and the cooling conveyance process (first processes), which are processes earlier than the post-treatment process (second process), is selected on the display device 8D of the post-treatment equipment 8, specific data for the molding process, the core mounting process, the melt pouring process, and the cooling conveyance process relating to the casting molds that are to be processed in the post-treatment process, which is a process later than the molding process, the core mounting process, the melt pouring process, and the cooling conveyance process, is displayed in a manner similar to that explained by using FIG. 4 to FIG. 7 and FIG. 9.

As such, the control device displays specific data for a first process (for example, the molding process, the core mounting process, the melt pouring process, or the cooling conveyance process), associated with a casting mold that is to be processed in a second process (for example, the post-treatment process), on the display device provided on the equipment that is to execute the second process.

The overall control device 11 holds the sand treatment data table 208 depicted in FIG. 13. The sand treatment data table 208 is a table for managing sand treatment data relating to sand treatment, in which the sand treatment data are each associated with respective casting molds.

In the sand treatment equipment 10, the treatment sand movement time period, from when the properties of the molding sand are measured, the sand is discharged from the sand treatment equipment 10, supplied to the molding equipment 2 by the conveyor 131 and molded, until the casting molds 19A are discharged from the molding equipment 2, is basically substantially constant.

For this reason, every time sand treatment data is received from the sand treatment equipment 10, the overall control device 11 first adds a line corresponding to a new casting mold to the sand treatment data table 208, and registers each of the sand treatment data received from the sand treatment equipment 10, except for casting mold identification numbers, in each box in this added line.

When the overall control device 11 receives specific data from the molding equipment 2, adds a line corresponding to the new casting mold to the product information table 200, issues a new casting mold identification number, and registers the casting mold identification number and the molding time, the overall control device 11 further estimates the time of measurement of the sand properties of the molding sand used to mold the relevant casting mold by subtracting the above-mentioned treatment sand movement time period from the molding time. The overall control device 11 compares this estimated time with the respective measurement times (IDST measurement times in FIG. 13) in the sand treatment data table 208, and registers the newly issued casting mold identification number in the casting mold identification number box for the measurement results with the closest measurement time in the sand treatment data table 208.

The overall control device 11 transmits the sand treatment data table 208 to the control panels 2P, 3P, 4P, 7P, 8P, and 10P corresponding to the sand treatment process, and to the molding process, the core process, the melt pouring process, the cooling conveyance process, and the post-treatment process, which are processes later than the sand treatment process. In these control panels 2P, 3P, 4P, 7P, 8P, and 10P, the received sand treatment data table 208 is displayed on the display device 2D, 3D, 4D, 7D, 8D, and 10D, for example, as depicted in FIG. 13, when the sand treatment button B9 is selected with the input device 2N, 3N, 4N, 7N, 8N, and 10N.

As such, by associating casting mold identification numbers with specific data for the sand treatment process, the overall control device 11 associates with the casting molds, separately for the casting molds in each frame, the specific data for the sand treatment process relating to the casting molds in each frame.

The control device displays specific data for a first process (for example, the sand treatment process), associated with a casting mold that is to be processed in a second process (for example, the molding process, the core mounting process, the melt pouring process, the cooling conveyance process, and the post-treatment process), on the display device provided on the equipment that is to execute the second process.

The overall control device 11 is provided with a display device 11D and an input device 11N. The display device 11D displays the information held by the overall control device 11, such as the content of the respective tables mentioned above.

The display device 11D of the overall control device 11 displays a sand treatment button B9 corresponding to the sand treatment process, a product button B1 corresponding to the molding process, a casting mold button B2, a core button B4 corresponding to the core mounting process, a melt pouring button B5 corresponding to the melt pouring process, a cooling conveyance button B7 corresponding to the cooling conveyance process, and a post-treatment button B8 corresponding to the post-treatment process.

Additionally, an overall button B30 is displayed on the display device 11D of the overall control device 11. When the overall button B30 is selected by the input device 11N, all or some of the specific data that is linked to each other is displayed on the display device 11D as depicted in FIG. 14.

In the present embodiment, when the overall button B30 is selected, the molding times, the pattern numbers, and the product numbers in the product information table 200 (see FIG. 4) are displayed from the specific data relating to the molding process, the core mounting time in the core data table 203 (see FIG. 6) is displayed from the specific data relating to the core mounting process, the casting time and the casting temperature in the melt pouring data table 204 (see FIG. 7) are displayed from the specific data related to the melt pouring process, the mold shake-out time in the cooling conveyance data table 206 (see FIG. 9) is displayed from the specific data related to the cooling conveyance process, the engraving time, the engraving type, the gate-cutting time, and the inspection results from the final inspection in the post-treatment data table 207 (see FIG. 12) are displayed from the specific data related to the post-treatment process, and the IDST measurement time, the sand temperature, the CB, and the water content in the sand treatment data table 208 (see FIG. 13) are displayed from the specific data related to the sand treatment process, the respective data being extracted and displayed in association with casting mold identification numbers.

Needless to say, the specific data displayed when the overall button B30 is selected and the combination thereof are not limited to what is described above.

As depicted in FIG. 12, the overall button B30 is also displayed on the display device 8D of the post-treatment equipment 8. Also, when the overall button B30 is selected in the input device 8N of the post-treatment equipment 8, all or some of the specific data that is linked to each other is displayed on the display device 8D of the post-treatment equipment 8 as depicted in FIG. 14.

In particular, in the present embodiment, the displayed boxes include inspection results in the post-treatment process.

As such, the control panel 8P (control device) of the post-treatment equipment 8 displays, on the display device 8D provided on the post-treatment equipment 8, the results of the final inspection of the casting 19E, together with specific data for other processes earlier than the post-treatment process, associated with the casting 19E. The display device 8D provided on the post-treatment equipment 8 may display the results of the final inspection of the casting 19E together with at least one type of specific data of a process earlier than the post-treatment process, associated with the casting 19E.

Next, the casting method with the casting equipment 1 described above will be explained by using FIGS. 1 to 14 and FIG. 15.

First, in the sand treatment equipment 10, a sand treatment is executed (step S1). During the sand treatment, sand properties are measured.

The control panel 10P of the sand treatment equipment 10 transmits sand treatment data to the overall control device 11, at a processing timing instructed by the overall control device 11, basically in the predetermined casting cycle mentioned above.

Upon receiving sand treatment data from the sand treatment equipment 10, the overall control device 11 adds a line corresponding to a new casting mold to the sand treatment data table 208, and registers each of the sand treatment data received from the sand treatment equipment 10, except for the casting mold identification number, in the respective boxes in the added line.

The molding sand for which the sand properties were measured is conveyed to the molding equipment 2 by the conveyor 131.

Next, the molding equipment 2 molds casting molds from the molding sand treated by the sand treatment equipment 10 (step S2). An upper casting mold and a lower casting mold that have been molded are temporarily vertically separated within the molding equipment 2, and after a core has been mounted therein, the molds are matched together (step S3) and discharged to the cooling conveyance equipment 4.

In the present embodiment, one set of casting molds are molded and discharged at a processing timing instructed by the overall control device 11, basically in the predetermined casting cycle.

The timer in the molding equipment 2 measures, with respect to the pair of an upper casting mold and a lower casting mold, as the molding time, the time at which a squeeze board in the molding equipment 2 finished squeezing the upper casting mold and the lower casting mold, and transmits the molding time to the control panel 2P of the molding equipment 2. The control panel 2P of the molding equipment 2 transmits the molding time of each casting mold to the overall control device 11 as specific data relating to the respective casting molds.

The molding equipment 2 measures each of the casting mold data by means of measuring devices. The control panel 2P in the molding equipment 2 receives these casting mold data measured by various measuring devices and transmits them to the overall control device 11.

The timer in the core mounting equipment 3 measures, with respect to the pair of an upper casting mold and a lower casting mold, as the core mounting time, the time at which the core was mounted therein, and transmits the core mounting time to the control panel 3P of the core mounting equipment 3.

The timer in the core mounting equipment 3 further measures the core installation time period. The control panel 3P of the core mounting equipment 3 receives the core mounting time and the core installation time period, and transmits them, as core data, to the overall control device 11.

Casting molds 19A produced in the manner described above are conveyed by the cooling conveyance equipment 4, as explained below. However, if a casting mold 19A becomes misaligned during this conveyance, then this is detected by the inspection device 2C.

The molding equipment 2 transmits the mold shift inspection results from the inspection device 2C to the control panel 2P. The control panel 2P transmits the mold shift inspection results to the overall control device 11.

Upon receiving the molding time and the casting mold data for each casting mold that has been molded from the molding equipment 2, the overall control device 11 issues a casting mold identification number specific to the casting mold that has been molded, adds a line corresponding to the new casting mold to the product information table 200, and registers the casting mold identification number that has been issued, and the molding time, the pattern number, the product number, the product name, and the material, as product data, in the respective boxes in the added line.

Additionally, when issuing a casting mold identification number and adding a line corresponding to the new casting mold to the product information table 200, the overall control device 11 adds a line corresponding to the new casting mold to the casting mold data table 201 as well, and registers the casting mold identification number that has been issued and the casting mold data that has been received from the molding equipment 2 in the respective boxes in the added line.

Upon receiving the core data from the core mounting equipment 3, the overall control device 11 adds a line corresponding to the new casting mold to the core data table 203, and registers the casting mold identification number that has been acquired in the manner already explained, and each of the core data received from the core mounting equipment 3, in the respective boxes in the added line.

The overall control device 11 further estimates the time at which the sand properties of the molding sand used for molding the relevant casting mold was measured by subtracting the treatment sand movement time period from the molding time. The overall control device 11 compares this estimated time with the respective measurement times in the sand treatment data table 208, and registers the newly issued casting mold identification number in the casting mold identification number box for the measurement result with the closest measurement time in the sand treatment data table 208.

The overall control device 11 transmits the sand treatment data table 208 to the control panels 2P, 3P, 4P, 7P, 8P, and 10P corresponding to the sand treatment process, and to the molding process, the core process, the melt pouring process, the cooling conveyance process, and the post-treatment process, which are processes later than the sand treatment process.

The overall control device 11 transmits the product information table 200, the casting mold data table 201, and the core data table 203 to the control panels 2P, 3P, 4P, 7P, and 8P corresponding to the molding process and the core process, and to the melt pouring process, the cooling conveyance process, and the post-treatment process, which are processes later than these processes.

A casting mold that has been molded is conveyed by the cooling conveyance equipment 4 (step S4). The melt is cast in the casting mold 19A by the melt pouring equipment 7 (step S5).

Each molding board cart 52 of the cooling conveyance equipment 4 moves the length of a single molding board cart 52 at a processing timing instructed by the overall control device 11, basically in the predetermined casting cycle mentioned above, so as to circulate between the first line 50 and the second line 51.

The automatic melt pouring device 72 of the melt pouring equipment 7 pours the melt into a casting mold 19A conveyed over the first line 50 at a processing timing instructed by the overall control device 11, basically in the predetermined casting cycle mentioned above.

At this point, for example, an operator selects the melt pouring selection button B20 displayed on the display device 7D with the input device 7N in the control panel 7P of the melt pouring equipment 7, thereby displaying a casting mold identification number of a casting mold 19A that is currently undergoing the melt pouring process, and inspection results for mold shift by the inspection device 2C corresponding thereto, as depicted in FIG. 8, and when the operator selects not to pour the melt on the display screen with respect to a casting mold corresponding to a casting mold identification number for which the inspection result "Mold shift" is displayed, melt is not poured into the casting mold corresponding to said casting mold identification number.

The timer in the melt pouring equipment 7 measures, with respect to a pair of an upper casting mold and a lower casting mold, as the casting time, the time at which the melt was cast therein, and transmits the casting time to the control panel 7P of the melt pouring equipment 7.

The control panel 7P of the melt pouring equipment 7 receives measurement values measured by the respective measurement devices in the melt pouring equipment 7, and transmits the measurement values, together with the ladle lot number (ladle number) corresponding to the ladle used to pour the melt, the material number, and the casting time, as the melt pouring data, to the overall control device 11.

Upon receiving the melt pouring data from the melt pouring equipment 7, the overall control device 11 adds a line corresponding to the new casting molds to the melt pouring data table 204, and registers the casting mold identification number that has been acquired in the manner already explained, and the melt pouring data received from the melt pouring equipment 7, in the respective boxes in the added line.

Additionally, the overall control device 11 registers casting results corresponding to the casting mold identification number that has been acquired in the product information table 200 in accordance with whether or not the melt has been poured in the casting mold.

The overall control device 11 transmits the melt pouring data table 204 to the control panels 4P, 7P, and 8P corresponding to the melt pouring process, and to the cooling conveyance process and the post-treatment process, respectively, which are processes later than the melt pouring process.

Weight-bearing melt-poured casting molds 19C in which the melt has been poured by the melt pouring equipment 7 is conveyed while being cooled by the primary cooling conveyance device 5, and arrives at the mold shake-out device 65.

In the mold shake-out device 65, mold shake-out is performed and the casting 19E is removed from the molding sand.

The casting 19E is conveyed while being cooled by the secondary cooling conveyance device 6.

The molding sand that formed the casting mold is recovered by the conveyor 101 and is supplied to the sand treatment process in step S1.

The control panel 4P of the cooling conveyance equipment 4 controls a driving unit so that the respective suspension devices 61 move over the casting rail by a distance equivalent to the spacing between adjacent suspension devices 61, at a processing timing instructed by the overall control device 11, basically in the predetermined casting cycle mentioned above.

The timer in the cooling conveyance equipment 4 measures, with respect to a pair of an upper casting mold and a lower casting mold, the mold shake-out time and the cooling time period, and transmits them to the control panel 4P of the cooling conveyance equipment 4. The control panel 4P of the cooling conveyance equipment 4 transmits the mold shake-out time and the cooling time period for each casting mold, as cooling conveyance data, to the overall control device 11.

Upon receiving cooling conveyance data from the cooling conveyance equipment 4, the overall control device 11 adds a line corresponding to the new casting molds to the cooling conveyance data table 206, and registers the casting mold identification number that has been acquired in the manner already explained, and each of the cooling conveyance data received from the cooling conveyance equipment 4, in the respective boxes in the added line.

The overall control device 11 transmits the cooling conveyance data table 206 to the control panels 4P and 8P corresponding to the cooling conveyance process, and to the post-treatment process, which is a process later than the cooling conveyance process.

The post-treatment process is executed (step S6) with respect to the casting 19E that has been cooled and conveyed. In the post-treatment equipment 8, the casting 19E is shot-blasted by a shot blasting device 82 and engraved by an engraving device 84.

Thereafter, each casting 19E is gate-cut to form one or more casting products.

The control panel 8P of the post-treatment equipment 8 controls the conveyor 83 so that a placement tool on the conveyor 83 moves by a distance equivalent to the spacing between adjacent placement tools, at a processing timing instructed by the overall control device 11, basically in the predetermined casting cycle mentioned above.

The timer in the post-treatment equipment 8 measures, with respect to a pair of an upper casting mold and a lower casting mold, the engraving time and the gate-cutting time, and transmits them to the control panel 8P of the post-treatment equipment 8.

Each casting product that has been formed by gate-cutting is inspected by an operator or the like. In the inspection, the casting products are checked regarding their dimensions, the presence or absence of flaws, and the like. The operator inputs with respect to the pair of an upper casting mold and a lower casting mold, to the control panel 8P, the inspection results of the final inspection on the one or more casting products formed by said casting molds.

The control panel 8P of the post-treatment equipment 8 transmits the engraving time and the engraving type, the gate-cutting time, and the inspection results of the final inspection for each casting, as post-treatment data, to the overall control device 11.

Upon receiving post-treatment data from the post-treatment equipment 8, the overall control device 11 adds a line corresponding to the new casting molds to the post-treatment data table 207, and registers the casting mold identification number that has been acquired in the manner already explained, and each of the post-treatment data received from the post-treatment equipment 8, in the respective boxes in the added line.

The overall control device 11 transmits the post-treatment data table 207 to the control panel 8P, which corresponds to the post-treatment process.

When the overall button B30 is selected in the input device 8N or 11N of the overall control device 11 or the control panel 8P of the post-treatment equipment 8, all or some of the specific data that is linked to each other is displayed on the display device 8D or 11D.

Next, the effects of the casting equipment and the casting method described above will be explained.

The above-mentioned casting equipment 1 is provided with a control device (overall control device 11, control panels 2P, 3P, 4P, 7P, 8P, and 10P) that acquires, regarding multiple processes, specific data regarding casting molds in each frame, and that associates the specific data for the respective processes with the casting molds, separately for the casting molds in each frame; and a display device provided, with respect to a first process among the multiple processes and a second process later than the first process, on equipment for executing the second process; wherein the control device displays, on the display device, the specific data for the first process associated with the casting molds that are to be processed in the second process.

According to the configuration described above, when a problem has occurred in a casting product during the casting in the casting equipment, the problem can be analyzed, based on the specific data for the respective processes corresponding to the casting molds in each frame, in an analysis environment from the perspective of overlooking the entire process by linking associated processes. Similarly, when changing the operating environment of the casting equipment in order to improve the quality of the castings, changes to the casting equipment that are effective for improving the quality can be extracted relatively easily by following the specific data that is linked across processes. By linking specific data across processes in this way, the trackability of measurement data is improved and the measurement data can be easily tracked and extracted.

Additionally, with the configuration described above, the specific data for the respective processes are associated with casting molds and these can be displayed on a display device, allowing the measurement data to be more easily tracked and extracted.

In particular, since specific data for a first process, which is an earlier process, is displayed on a display device provided on equipment for executing a second process, in the case in which, for example, some sort of problem has occurred in a casting mold undergoing the second process, the specific data from the earlier process associated with said casting mold can be checked at the site at which the second process is executed. Therefore, the problems can be immediately appropriately addressed, depending on the circumstances.

Additionally, the multiple processes include a molding process for molding the casting molds, and a melt pouring process for preparing a melt and pouring the melt in the casting molds; and the control device displays, on the display device 7D provided on melt pouring equipment 7 (equipment for performing the melt pouring process), the specific data for the molding process, including inspection results for the casting molds that have been molded, associated with the casting molds that are to be processed in the melt pouring process.

Additionally, the melt pouring equipment 7 (equipment for performing the melt pouring process) comprises an input device 7N that can receive inputs regarding whether or not to pour the melt into the casting mold that is to be processed next; and if the input device 7N has received the input that the melt is not to be poured, then the melt pouring equipment 7 does not pour the melt in the casting mold that is to be processed next.

According to the configuration described above, the melt pouring equipment 7 displays the inspection results for molded casting molds that are to be processed, and also, the melt pouring equipment 7 includes an input device 7N that can receive inputs regarding whether or not the melt is to be poured into casting molds that are to be processed next. Thus, in the case in which the input device 7N has received an input indicating that the melt is not to be poured, the melt pouring equipment 7 will not pour the melt into the casting molds that are to be processed next. Therefore, the melt can be kept from being poured into the casting molds in accordance with the inspection results. For this reason, the melt can be kept from being poured into casting molds with molding defects, thereby reducing unnecessary consumption of the melt.

Additionally, the multiple processes include a melt pouring process for preparing a melt and pouring the melt into the casting molds, and a cooling conveyance process for conveying and cooling the casting molds, the casting molds in which the melt has been cast, and a casting produced with the casting molds, the casting having, associated therewith, the same specific data as the casting molds from which the casting was produced; and the control device displays, on the display device 4D provided on the cooling conveyance equipment 4 (equipment for performing the cooling conveyance process), the specific data for the melt pouring process, including casting temperatures, associated with the casting molds that are to be processed in the cooling conveyance process.

According to the configuration described above, the casting temperatures are displayed in association with the casting molds. Therefore, it is possible to confirm, from the conveyance time period of a casting mold that is currently being conveyed and the temperature of the melt cast in said casting mold, for example, whether a sufficient cooling time period has been provided before mold knock-out is performed by the mold shake-out device 65, and based thereon, for example, the cooling conveyance can be set so as to require more time.

Additionally, the multiple processes include a molding process for molding the casting molds, and a cooling conveyance process for conveying and cooling the casting molds, the casting molds in which the melt has been cast, and a casting produced with the casting molds, the casting having, associated therewith, the same specific data as the casting molds from which the casting was produced; the cooling conveyance equipment 4 (equipment for performing the cooling conveyance process) comprises a mold shake-out device 65 that performs mold shake-out and that separates molding sand from the casting; and the control device displays, on the display device 4D provided on the cooling conveyance device 4, the specific data for the molding process, including one or both of pattern numbers, which are numbers of patterns used for molding, and product numbers of the castings produced by said casting molds, associated with the casting molds that are to be processed in the mold shake-out device 65.

According to the configuration as described above, when performing mold shake-out in the mold shake-out device 65, the pattern number and the product number of said casting mold can be checked.

Additionally, the multiple processes include a post-treatment process for performing a post-treatment including a final inspection of a casting produced with the casting molds, the casting having, associated therewith, the same specific data as the casting molds from which the casting was produced; and the control device displays, on the display device 8D provided on the post-treatment equipment 8 (equipment for performing the post-treatment process), results of the final inspection of the casting and the specific data, for at least one process earlier than the post-treatment process, associated with the casting.

According to the configuration described above, together with the results of a final inspection of a casting, specific data for at least one process earlier than the post-treatment process associated with said casting can be displayed, thereby making the data easier to track and extract.

Additionally, the above-mentioned casting method comprises acquiring, regarding multiple processes in the casting equipment 1, specific data regarding casting molds in each frame, and associating the specific data for the respective processes with the casting molds, separately for the casting molds in each frame; and displaying, with respect to a first process among the multiple processes and a second process later than the first process, the specific data for the first process associated with the casting molds that are to be processed in the second process, on a display device provided in equipment for executing the second process.

According to the configuration described above, measurement data is easier to track and extract.

The casting equipment and the casting method of the present invention are not limited to the above-mentioned embodiments explained with reference to the drawings, and various other modifications can be contemplated within the technical scope thereof.

For example, in the above-mentioned embodiments, the molding equipment 2 is of the flaskless type, but it may be of the flask type. That is, in this case, the molding equipment is configured in a manner that a lower casting mold equipped with a lower flask and an upper casting mold equipped with an upper flask are alternately supplied to the cooling conveyance equipment, a core is mounted by core mounting equipment located, separately from the molding equipment, downstream from the molding equipment on the cooling conveyance equipment, then the upper casting mold equipped with upper flask and the lower casting mold equipped with the lower flasks are mounted and matched together by a mold matching device, then the melt is poured.

Needless to say, even such casting equipment, based on principles similar to those in the above-mentioned embodiments, can have a configuration in that there are provided a control device that acquires, regarding multiple processes, specific data regarding casting molds in each frame, and that associates the specific data for the respective processes with the casting molds, separately for the casting molds in each frame; and a display device provided, with respect to a first process among the multiple processes and a second process later than the first process, on equipment for executing the second process; wherein the control device displays, on the display device, the specific data for the first process associated with the casting molds that are to be processed in the second process. In this case, the combination of a lower casting mold equipped with a lower flask and an upper casting mold equipped with an upper flask corresponds to the casting molds in each frame.

In the above-mentioned embodiments, the inspection device 2C performs a mold shift inspection. However, in flask casting equipment as mentioned above, such inspections may be replaced by inspections of the surfaces of the lower casting mold with the lower flask and the upper casting mold with the upper flask to form a casting, located on the inner sides when the lower casting mold with the lower flask and the upper casting mold with the upper flask are matched together. More specifically, for example, mold drop inspections are performed for the absence of surfaces corresponding to portions for forming corners of the casting. In such cases, mold drop inspection results may be registered in the control device as post-molding inspection results.

Aside from the above, the configuration mentioned in the above-mentioned embodiments may be adopted or rejected, or changed, as appropriate, to other configurations, as long as the results do not depart from the spirit of the present invention.

REFERENCE SIGNS LIST

1 Casting equipment
2 Molding equipment
2P Control panel (control device)
2D Display device
3 Core mounting equipment
3P Control panel (control device)
3D Display device
4 Cooling conveyance equipment (equipment for performing cooling conveyance process)
4P Control panel (control device)
4D Display device
7 Melt pouring equipment (equipment for performing melt pouring process)
7P Control panel (control device)
7D Display device
7N Input device
8 Post-treatment device (equipment for performing post-treatment process)
8P Control panel (control device)
8D Display device
10 Sand treatment equipment

10P Control panel (control device)
10D Display device
11 Overall control device (control device)

The invention claimed is:

1. Casting equipment comprising:

a control device configured to acquire, regarding a first process among multiple processes in the casting equipment, specific data regarding casting molds, and configured to associate the specific data for the first process with identification information of the casting molds, separately for each of the casting molds; and a display device provided on equipment for executing a second process after the first process among the multiple processes;

wherein the control device is configured to:

display, on the display device, the specific data for the first process associated with the identification information of the casting molds that are to be processed in the second process, estimate, with respect to a casting mold to be processed in the second process, a first time corresponding to a position of the first process based on a second time corresponding to a position of the second process and time for changing position of the casting mold, acquire identification information corresponding to the casting mold based on the estimated first time, and associate the specific data for the second process with the acquired identification information of the casting mold.

2. The casting equipment according to claim 1, wherein:

the first process is a molding process in which the casting molds are molded, the second process is a melt pouring process in which melt is prepared and the melt is poured in the casting molds; and the control device is configured to display, on the display device provided on equipment for performing the melt pouring process, the specific data for the molding process, including inspection results for the casting molds that have been molded, associated with the identification information of the casting molds that are to be processed in the melt pouring process.

3. The casting equipment according to claim 2, wherein:

the equipment for performing the melt pouring process comprises an input device that is configured to receive inputs regarding whether or not to pour the melt into the casting molds that are to be processed next; and when the input device has received the input that the melt is not to be poured, the equipment for performing the melt pouring process does not pour the melt in the casting molds that are to be processed next.

4. The casting equipment according to claim 1, wherein:

the first process is a melt pouring process including preparing melt and pouring the melt into the casting molds, the second process is a cooling conveyance process including conveying and cooling the casting molds, the casting molds in which the melt has been cast, and a casting produced with the casting molds, the casting having, associated therewith, the same specific data as the casting molds from which the casting was produced; and the control device is configured to display, on the display device provided on equipment for performing the cooling conveyance process, the specific data for the melt pouring process, including casting temperatures, associated with the identification information of the casting molds that are to be processed in the cooling conveyance process.

5. The casting equipment according to claim 1, wherein:

the first process is a molding process for molding the casting molds, the second process is a cooling conveyance process for conveying and cooling the casting molds, the casting molds in which the melt has been cast, and a casting produced with the casting molds, the casting having, associated therewith, the same specific data as the casting molds from which the casting was produced;

the equipment for performing the cooling conveyance process comprises a mold shake-out device that performs mold shake-out and that separates molding sand from the casting; and the control device is configured to display, on the display device provided on the equipment for performing the cooling conveyance process, the specific data for the molding process, including one or both of pattern numbers, which are numbers of patterns used for molding and product numbers of the casting produced with said casting molds, associated with the identification information of the casting molds that are to be processed in the mold shake-out device.

6. The casting equipment according to claim 1, wherein:

the second process is a post-treatment process including performing a post-treatment including a final inspection of a casting produced with the casting molds, the casting having, associated therewith, the same specific data as the casting molds from which the casting was produced; and the control device is configured to display, on the display device provided on equipment for performing the post-treatment process, results of the final inspection of the casting and the specific data, for the first process, associated with the casting.

7. A casting method comprising:

acquiring, regarding a first process among multiple processes in casting equipment, specific data regarding casting molds, and associating the specific data for the first process with identification information of the casting molds, separately for the each of the casting molds;

displaying the specific data for the first process associated with the identification information of the casting molds that are to be processed in a second process after the first process among the multiple processes, on a display device provided in equipment for executing the second process, estimating, with respect to a casting mold to be processed in the second process, a first time corresponding to a position of the first process based on a second time corresponding to a position of the second process and time for changing position of the casting mold;

acquiring identification information corresponding to the casting mold based on the estimated first time; and associating the specific data for the second process with the acquired identification information of the casting mold.

* * * * *